US006547683B1

(12) United States Patent
Howgate

(10) Patent No.: US 6,547,683 B1
(45) **Date of Patent: *Apr. 15, 2003**

(54) HOCKEY STICK

(76) Inventor: Ian Robert Malcolm Howgate, 9 Acomb Crescent, Charlton Kings, Cheltenham Gloucestershire GL52 6YH (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/180,200

(22) PCT Filed: May 2, 1997

(86) PCT No.: PCT/GB97/01212

§ 371 (c)(1),
(2), (4) Date: Nov. 4, 1998

(87) PCT Pub. No.: WO97/41929

PCT Pub. Date: Nov. 13, 1997

(30) Foreign Application Priority Data

May 4, 1996 (GB) ..... 9609432

(51) Int. Cl.[7] ..... A63B 59/12

(52) U.S. Cl. ..... 473/560

(58) Field of Search ..... 473/560–563

(56) References Cited

FOREIGN PATENT DOCUMENTS

| | | | |
|---|---|---|---|
| GB | 935442 | 8/1963 | |
| GB | 2 115 296 | 9/1983 | |
| GB | 2 205 757 | 12/1988 | |
| WO | WO 88/09687 | 12/1988 | |
| WO | 94/21334 | * 9/1994 | ..... 473/FOR 189 |

* cited by examiner

*Primary Examiner*—Mark S. Graham
(74) *Attorney, Agent, or Firm*—Young & Thompson

(57) ABSTRACT

A hockey stick has a head (3) with an enlarged gape (20) with an extended toe height (T). The stick exhibits a circulation effect whereby when placed face down on a ball with the lowermost part of the outer edge of the stick in contact with the ground, the stick may be twisted in one direction to the open stick playing position and in the other direction to the reverse stick playing position, whilst the spatial position of the stick is not varied and the outer edge is in rolling contact with the ground and without disturbing the ball. The head also provides enhanced catching features which provide significantly increased control of the ball during play.

11 Claims, 20 Drawing Sheets

HOCKEY STICK

This invention relates to improved hockey sticks, and in particular, but not exclusively, to hockey sticks intended for outfield players.

In this Specification, various terms are used to describe the shape and geometry of the hockey sticks of this invention and these terms will now be explained with particular reference to FIGS. 1 to 8 of the accompanying drawings. All measurements of distance or related constants are given in centimetres (cm), and all angular measurements or constants are given in degrees. In the accompanying drawings most of the various embodiments of hockey sticks are viewed from the back, (i.e. showing the non-playing side) and references to vertical, horizontal, rearward, forward etc, refer to the stick when viewed in the orientation of FIG. 1, that is with the axis of the handle and shaft generally vertical, with the toe painting away from the player (i.e. forwardly). However some are viewed from the front (i.e. showing the playing side of the stick) and this will be apparent because in these Figures the toe will be to the left of the shaft as viewed.

Playing on the open stick means playing the stick forehand in the usual attitude with the toe of the stick pointing away from the player and the bulk of the stick on the player's right hand side, and playing on the reverse stick means playing the stick backhand with the stick flipped through 180° around the axis of the handle, so that the toe is nearest the ground and the bulk of the stick lies an the player's left hand side. When the stick is held on the reverse stick side with the free end of the toe in contact with the ground and the shaft held mare or less parallel to the ground, the action is known as a reverse stick block.

The traditional form hockey stick is made up of tour portions, namely a handle 1, a shaft 2, a head 3, and a toe 4. The handle extends for the upper part (e.g. three-fifths or so) of the stick, merging with the shaft 2 which occupies the majority of the remaining part of the stick. The head 3 occupies a small proportion of the vertical dimension at the base of the stick, but the bulk of the horizontal dimension. The head lies intermediate the shaft and the toe. The toe 4 lies at the lowest free end of the stick, and the region of the outer edge of the stick adjacent the merger of the head and the shaft is referred to as the heel. The front area of the stick is known as the face and is the allowable playing surface.

The perpendicular distance across the face between the edges 5 and 6 at any point is defined as the width of the face (F). The edge 5 furthest away from the player when the stick is held in open stick is the inner edge and the other edge 6 is the outer edge.

The handle 1 has traditionally bean straight in the vertical dimension and the central axis of the handle has continued directly into the shaft portion which has also tended to have straight edges 5 and 6.

In many conventional sticks, the first curve is forward in direction, beginning at and defining the upper extent of the head portion 3. A forward curve is an anti-clockwise rotation, when viewing the back of the stick, starting from the handle end and moving towards the toe end.

In a traditional stick, the head may be taken to be the curved portion at the base of the shaft, the notional dividing line between the shaft and the head being a horizontal line running through the point or region where the generally straight outer edge of the shaft meets the outer curved edge of the head. However, if the shaft of the stick incorporates a curve before it reaches the head, the head is defined as the lowermost forward curving element. The notional dividing fine between the shaft and the head in this instance is defined by taking the lowermost vertical tangent line to the inner edge of the stick, and the lowermost vertical tangent line to the outer edge of the stick, determining the higher point of contact of these tangent lines to the stick, and taking as the notional dividing line a horizontal line intersecting the higher point of contact.

The head although predominantly curved, may have straight or near-straight sections within it that break up the curvature of the inner or outer edge of the head.

The toe 4 is usually rounded, forming the lower end of the stick, having a distal edge which meets both the inner and outer edges of the head. The national dividing line of contact between the head and toe is defined by reference to the principle inflexion point 7 on the inner edge of the head, i.e. the last inflexion point before the edge begins to curve convexly into the toe. Minor variations in curvature such as indicated at 5 in FIG. 8 should be ignored. The toe region should be short and usually no more than a 2 cm extension upon the head. The toe may be cut away or truncated as shown by the dotted lines 21 in FIGS. 1 and 2. Likewise the heel may be cut away in some sticks, as in FIG. 36.

The current rules of the game lay certain restrictions upon the shape of a stick. These are detailed with reference to FIG. 4. The width of the face of the stick (F) must not exceed 5 cm and the stick must pass entirely through a ring of metal of 5 cm internal diameter known as a "stick ring". The height of toe (T) must not exceed 10 cm. Further the Rules Board make the following recommendation: the forward deviation (Cf) should not exceed 2 cm, the rearward deviation (Cr) should not exceed 2 cm.

Over the years the design of the hockey stick has changed from sticks with long and gentle curved heads to sticks with short and/or tightly curved heads. FIGS. 9(*a*) to (*n*) show schematically the variation in stick design and its development over the years, with FIGS. 9(*o*) and (*p*) showing sticks in accordance with the invention.

All sticks have three operational axes, each being defined by a line that runs from the top of the handle to the base of the head. The rotational axis of the handle runs down the median line of the handle and continues down to the head. The spatial axis starts at the top of the handle and ends at the central rotation point of the head, that is the lowest point of the outer edge of the head, and is the predominant axis of rotation in game play due to the physical presence of the head against the ground. The axis of balance is defined by the line of even weight distribution down the length of the stick and is the line that the stick would most comfortably rotate around in free space.

When designing a stick it is desirable to bring these three axes close together, hence making handling of the stick during play as comfortable as possible. In most prior art sticks, these axes have a spread of around 4–5 cms.

Furthermore, it is desirable to increase the playing surface available when the player is playing reverse stick or backhand, balancing the playing ability on both sides. It is also important to prevent the possibility of a hockey ball passing through the gap between the stick and the ground when in a reverse stick block.

There have been several attempts to satisfy at least some of these criteria. British Patent Specification 2115296 describes a stick in which the head is a compact U-shaped hook bending through about 180°, typified by the stick shown in FIG. 9(*d*). The gap between the head and the shaft is of elongate form gradually tapering and terminating at its highest position with a gape which is made as small as possible, whilst still allowing the stick to pass the "ring pass" test, and is typically about half the width of the shaft region. Whilst this form of stick has some benefits, particularly in respect of the reverse stick block, it provides an ungainly movement in rotation due to the size of the upturned limb of the head which displaces the axis of balance from the rotational axis.

European Published Application 0165096 discloses a hockey stick in which the lower end of the shaft is curved rearwardly, then correctionally forwardly before meeting the head which is curved forwardly to bring the sweet spot of the head onto the longitudinal axis of the handle whilst making the head of the stick symmetrical about the same longitudinal axis. This eases rotation about the ball by bringing the spatial axis onto the rotational axis of the handle and a typical form of such a stick is shown in FIGS. 9(*e*) or 9(*j*). Although such a slick has advantages when used in the reverse stick block position and the symmetry helps equate the playing ability on the open and reverse stick sides, the stick has a failing that, in balancing the position of the head, the mass distribution of the stick about the central axis is unbalanced by the mass of the shaft on the rearward side, moving the axis of balance away from the rotational axis of the handle. Furthermore, recommendations of the Rule Board restrict the rearward displacement to 2 cm and the head produced is substantially compact with a small gape (as herein defined), generally less than 1.5 cm British Patent 2205757B discloses an arrangement in which the lower end of the shaft has a zig-zag shape comprising a forward curve 19 continuing into a rearward curve and a correctional forward curve from which the head curves around to provide a small gape (as herein defined) of typically 1 cm (see for example FIG. 9(*k*)). This form of stick is better balanced than some of the above sticks but still exhibits only a compact playing area on the open and reverse stick sides and the gape (as herein defined) is likewise small.

SUMMARY OF THE INVENTION

As a professional coach, I have analysed the features of existing sticks and also the dynamics of the strategy of the game itself. I have found that player's skill and ball control can be considerably improved by redesigning the stick to provide the unusual and innovative feature of a catching region which allows a player to cradle the hockey ball when on the ground to allow stable catching and movement of the ball, which I refer to as "catching". Furthermore, in the preferred aspects, the catching feature allows the potential for the stick to be rolled around the ball from the open to reverse position and back without having to lift the head of the stick from the ground or vary the position of the hands from a comfortable dribbling position, whilst leaving the ball undisturbed in the process which I refer to as "circulation".

Accordingly, I have designed a range of hockey sticks which have enlarged heads exhibiting a generous gape and which are shaped to allow closer control of the ball when the stick is used face down to trap and drag or swing the ball along the ground. In a preferred aspect, when the stick is used to propel the ball from side to side from the open to reverse stick in a comfortable dribbling action the illustrated embodiments are guided by contact between the stick and the ground, thus providing a novel effect not available in prior art sticks. Furthermore in their preferred configurations my range of sticks provide good mass distribution to assist balance and handling together with extended and balanced playing area for both forward and reverse stick shots and control whilst preventing the passage of the ball beneath the shaft when the stick is laid in a reverse stick block.

Accordingly, in a broad aspect, this invention provides a hockey stick having a maximum gape (as herein defined) of at least 3 cm between the limbs of the head and the shaft. Preferably the head has a curvature of at least 140°. The maximum gape is preferably at least 3.5 cm, and in some embodiments approximately 5.5 cm.

Depending on which control feature is required, the gape (G) and the maximum gape height (H) may be selected in accordance with one or more of the following relationships, as follows:

$$G>7.7-2H/5$$

$$G>7.65-4H/11$$

$$G>10.3-4H/5$$

$$G>5H/6-1.25$$

Advantageously the gape (G), the perpendicular distance (L) from the centre of the gape circle to the centre of a notional hockey ball cradled by said gape circle, and the gape playing angle ($\alpha$) (as herein defined) obey the following relationship:

$$G>2\,L\tan\alpha$$

Preferably the toe height (T) (as herein defined) is greater than 8 cm.

Preferably the overall width of the head (W) (as herein defined) is greater than 12.5 cm.

Preferably the circumference of rotation (Cor) on the outer edge of the head between the open stick rotational contact point (RCPo) and the reverse stick rotational contact point (RCPr) (as herein defined) is greater than 11 cm.

In the preferred embodiments of this invention the playing surface toe extension (PSTE) (as herein defined) is greater than 3.5 and preferably is greater than 4.5 cm.

The stick may advantageously incorporate a rearward curve in the region of the stick adjacent the merger of the shalt and the head. Likewise a zig zag configuration may also be advantageously incorporated.

The head of the stick may have a face with an inclined or shallow conical profile.

The angle or angles of inclination of said surface to a notional vertical plane may lie in the range of up to 20°, and typically from 5° to 15°.

In another aspect this invention provides a hockey stick wherein at least the head is formed of a plurality of laminar elements having interposed therebetween reinforcing elements of a reinforcing material. The laminar elements may extend in planes generally parallel to the playing surface of the stick, or they may extend in planes generally perpendicular to the playing surface, and generally follow the line of the curve of the head. The reinforcing material may be selected from the group comprising carbon fibre material, glass or mineral fibre material, and synthetic fibre material, such as quartz aramid fibre. The reinforcing elements extend across substantially the whole of the width of the laminar elements, or they may be at least partially received in recesses in said laminar elements and extend across only part of the width thereof. The laminar elements may be of wood but other materials are not excluded According to another aspect of this invention, there is provided a hockey stick having an enlarged head region incorporating the stick head, the head region being shaped and dimensioned with regard to the diameter of a standard hockey ball such that from a position in which the stick is placed face down on a hockey ball with the lowermost portion of the outer edge of the head on the ground, the stick may be twisted in one sense to an open stick playing position and in the other sense to a reverse stick playing position, in each case with the outer edge of the stick in rolling contact with the ground and without significantly disturbing or encroaching on said hockey ball.

Whilst the invention has been described above it extends to any inventive combination of the features set out above or in the following description and drawings.

The invention may be performed in various ways and various embodiments thereof will now be described in detail, reference being made to the accompanying drawings in which.

Figure 7A:
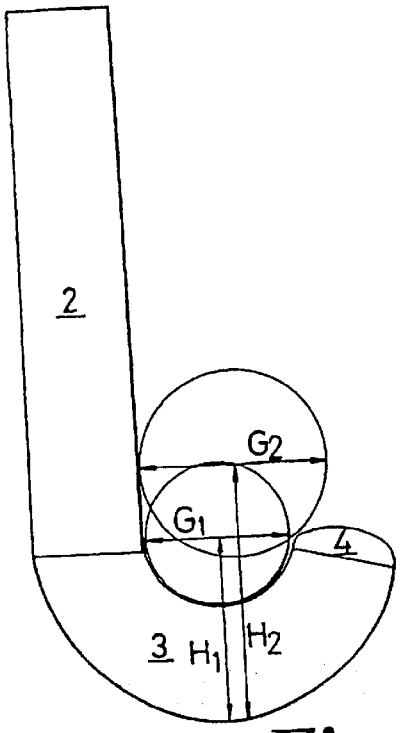
Figure 7B:
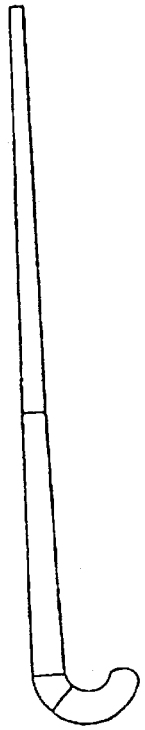
Figure 8A:
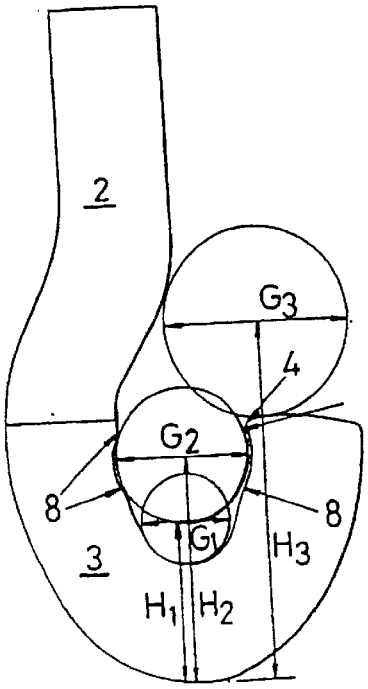
Figure 8B:
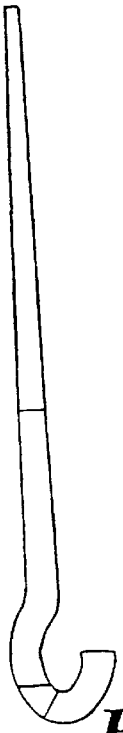
Figures 9A, 9B, 9C, 9D, 9E, 9F, 9G:
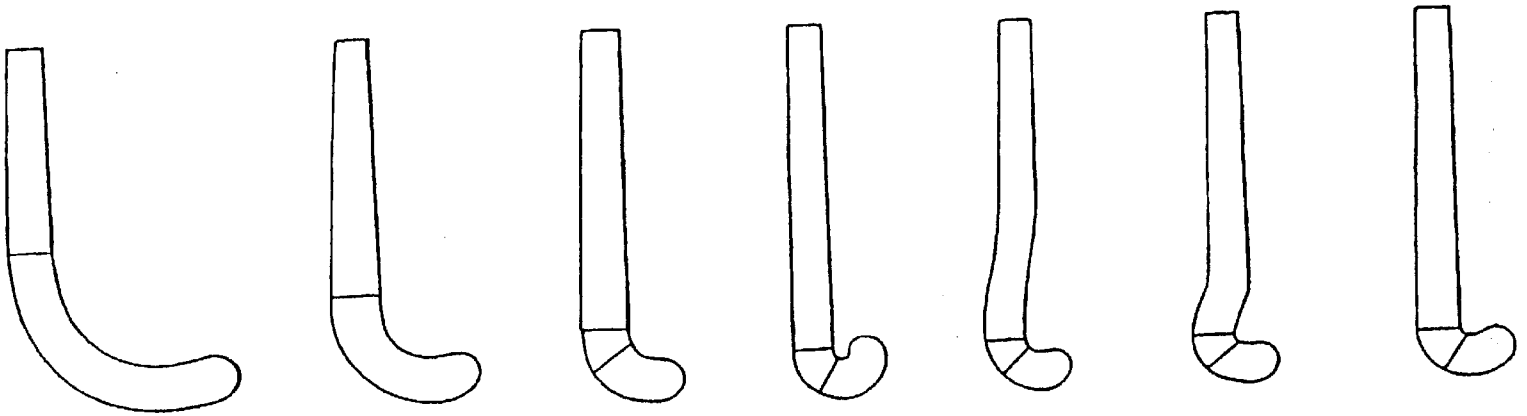
Figures 9H, 9I, 9J, 9K, 9L, 9M, 9N, 9O, 9P:
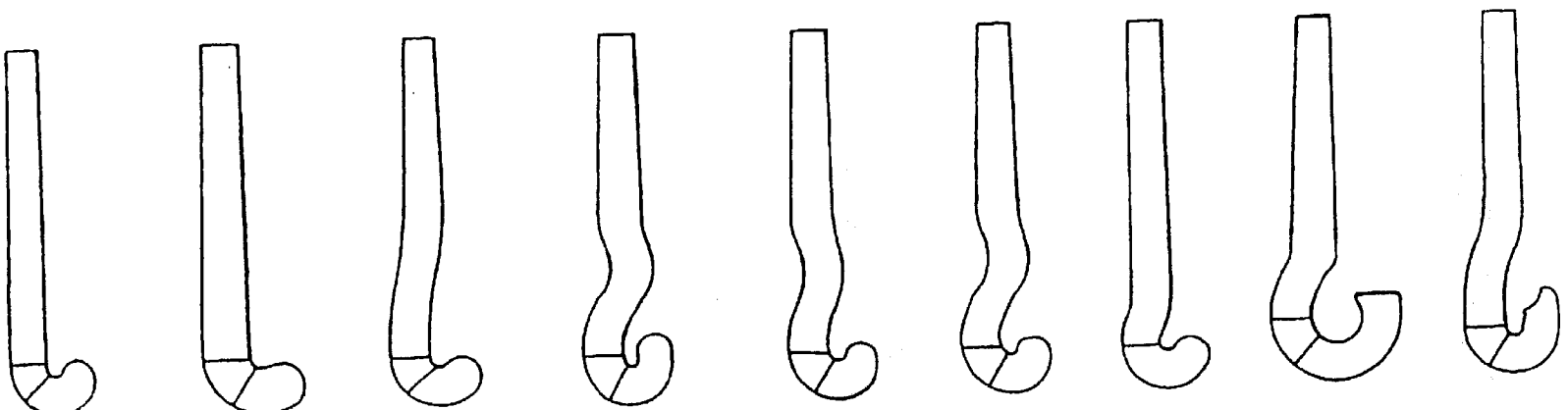
Figure 10:
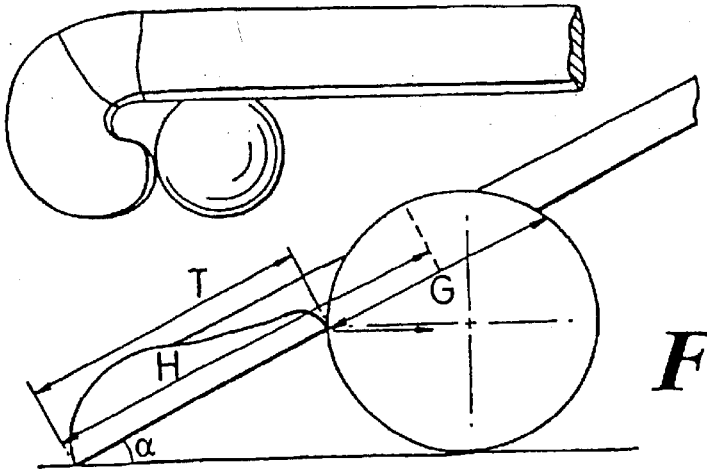
Figure 11:
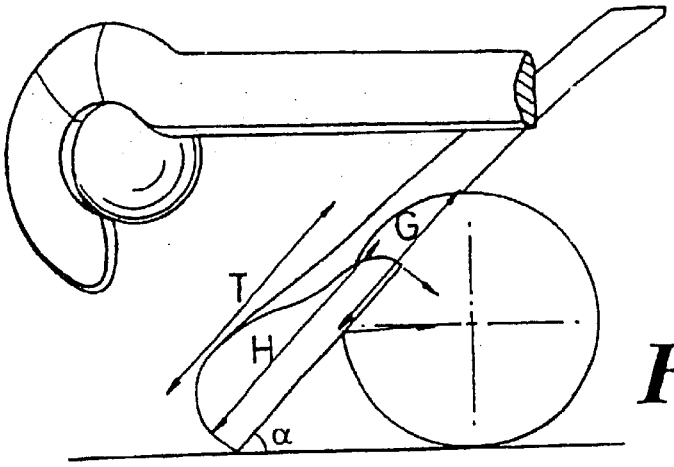
Figure 12:
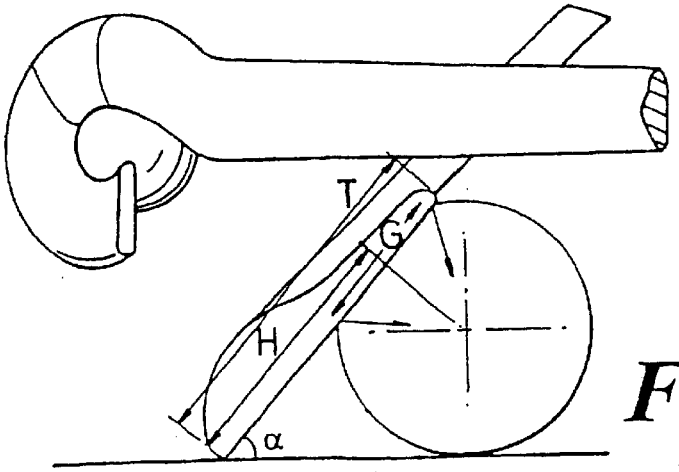
Figure 13:
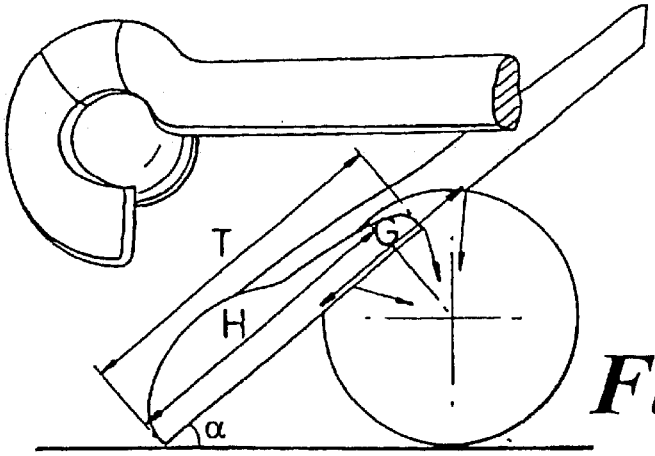
Figure 14:
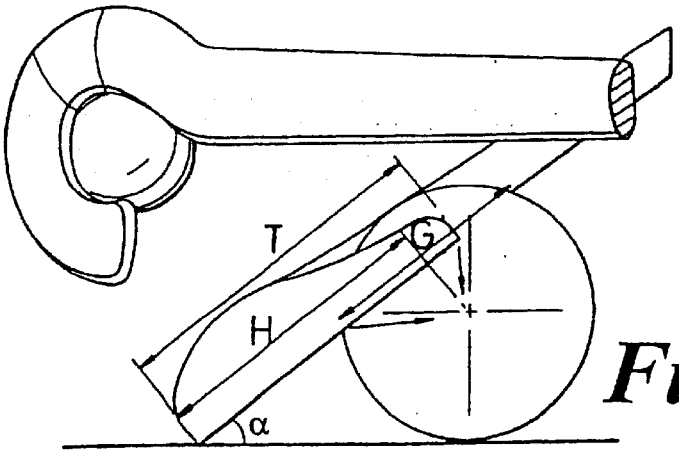
Figure 15:
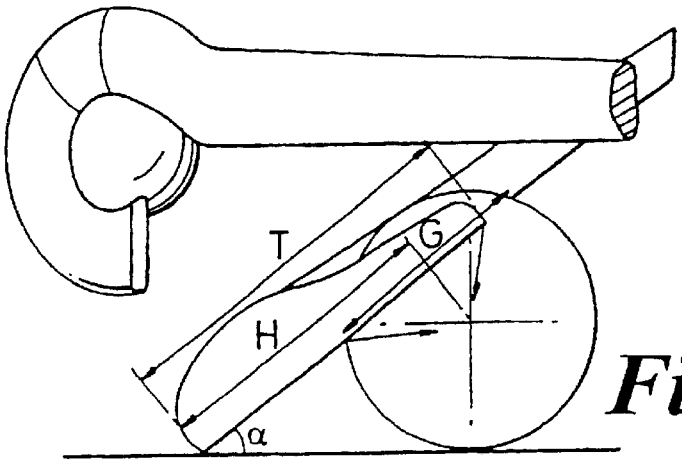
Figure 16:
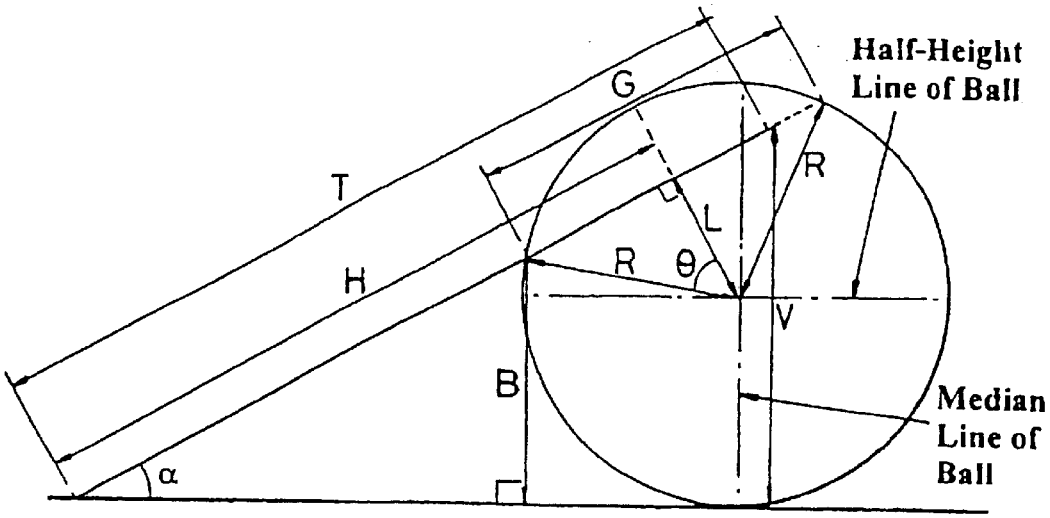
Figure 17:
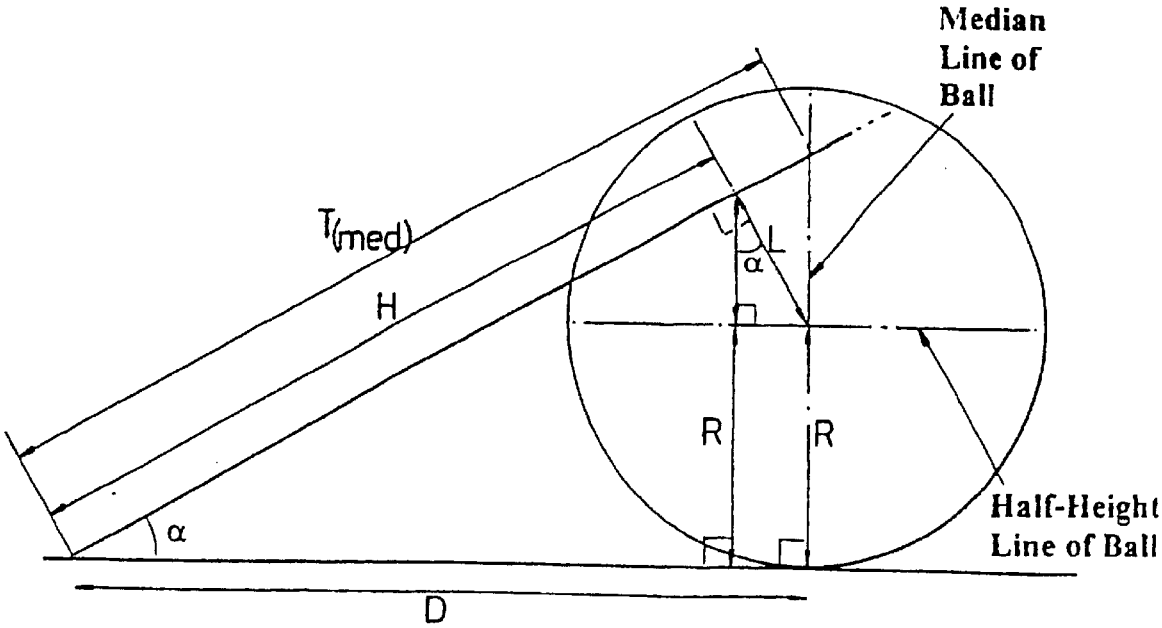
Figure 18:
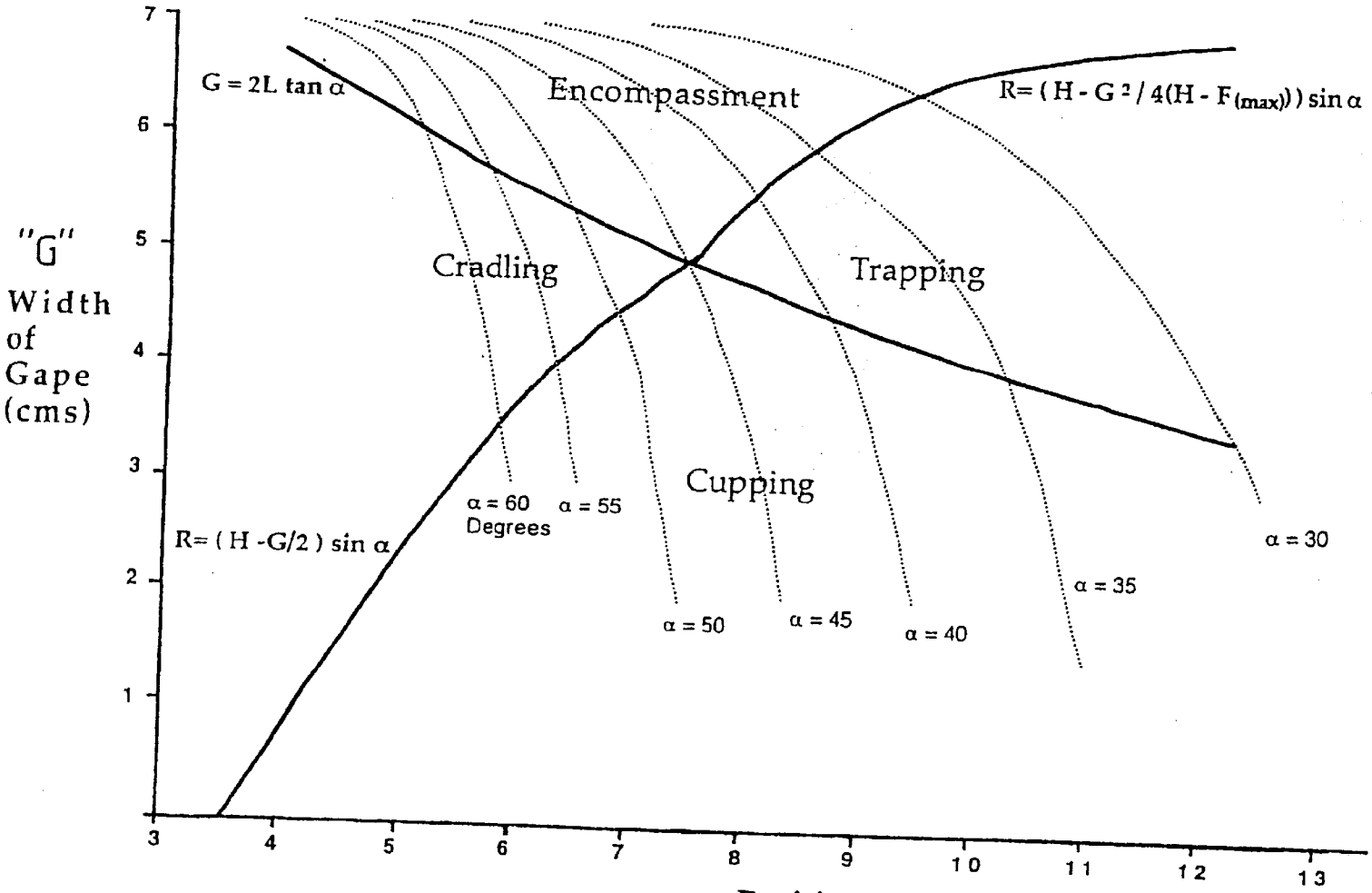
Figure 19:
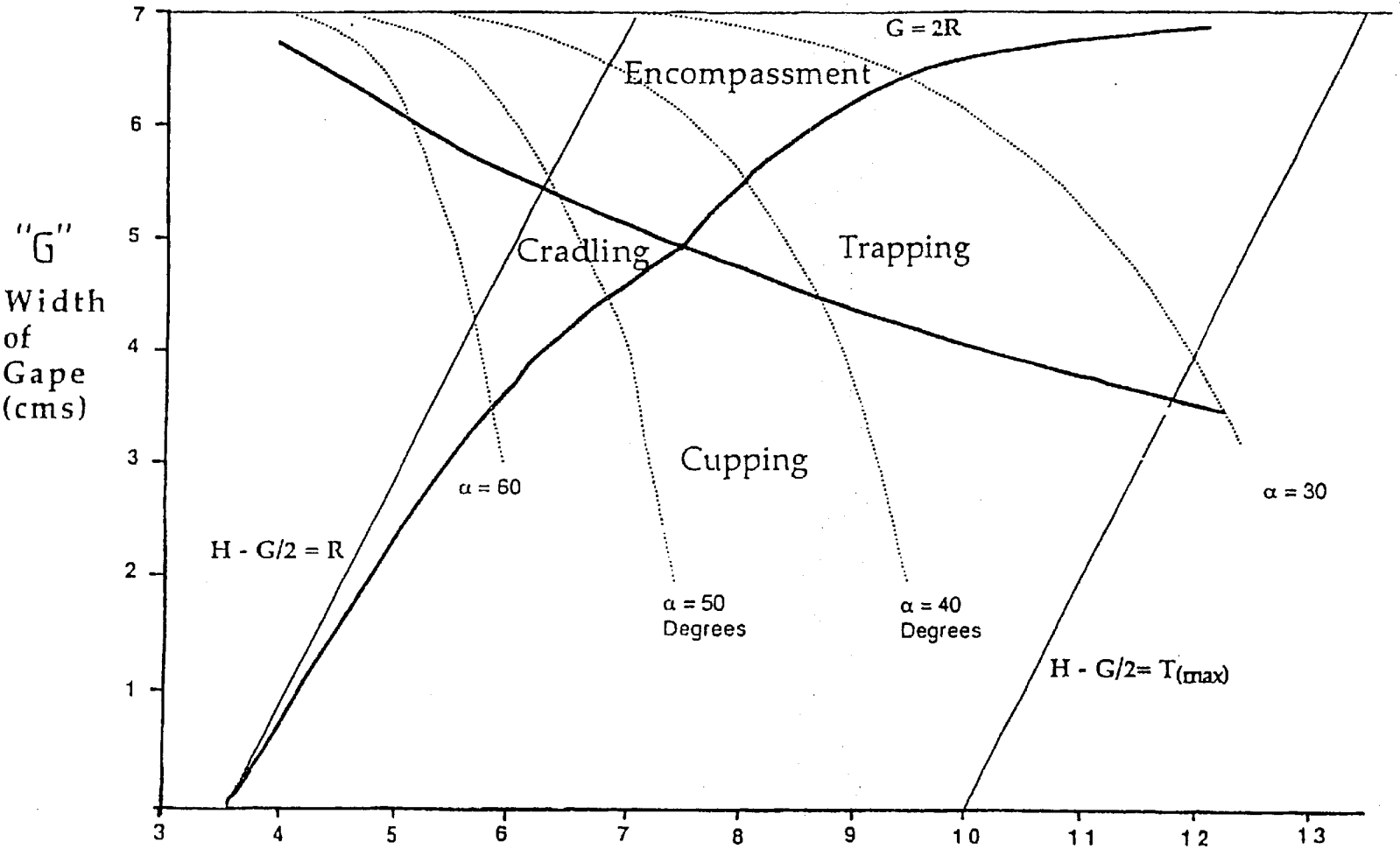
Figure 20:
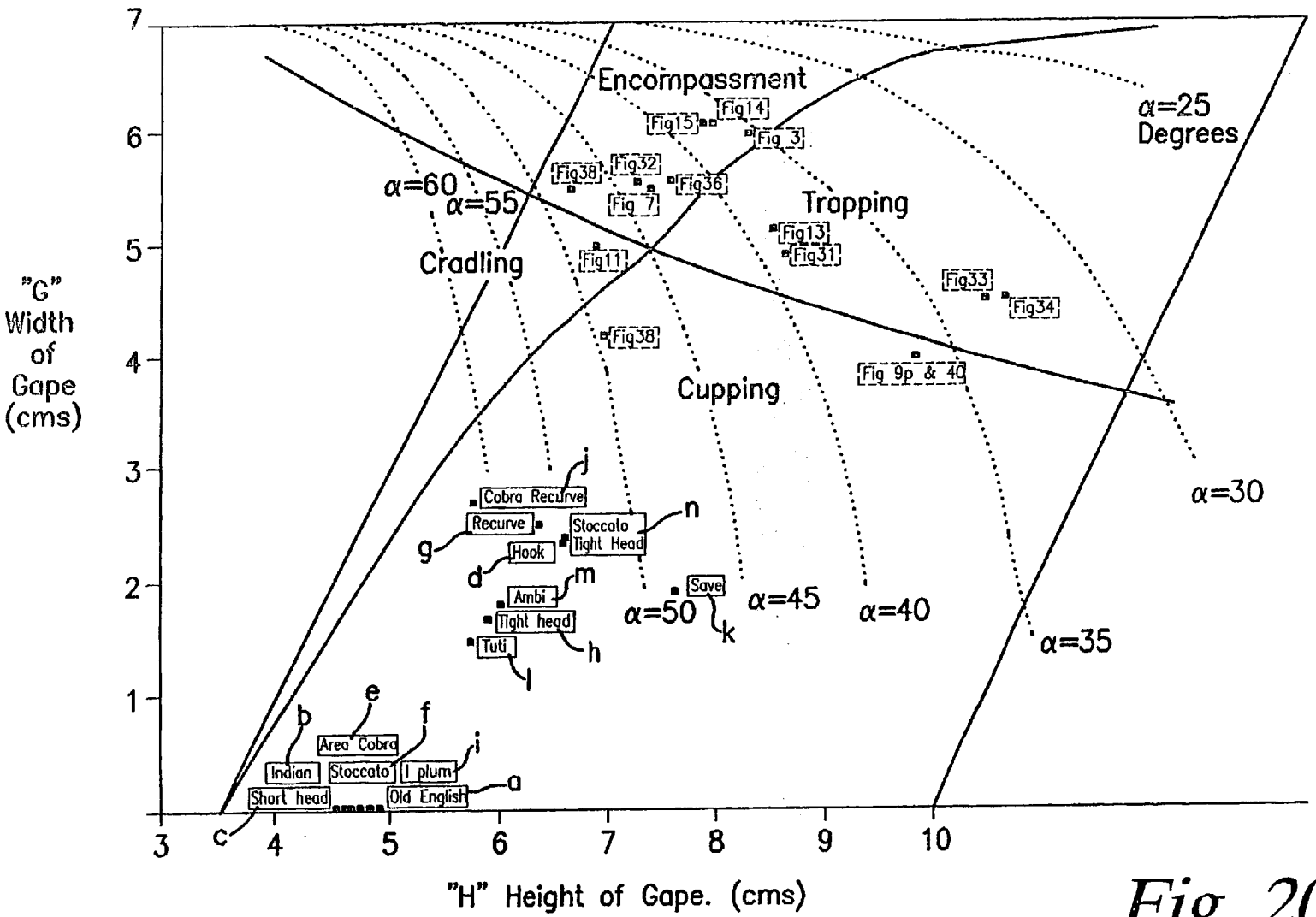
Figure 21:
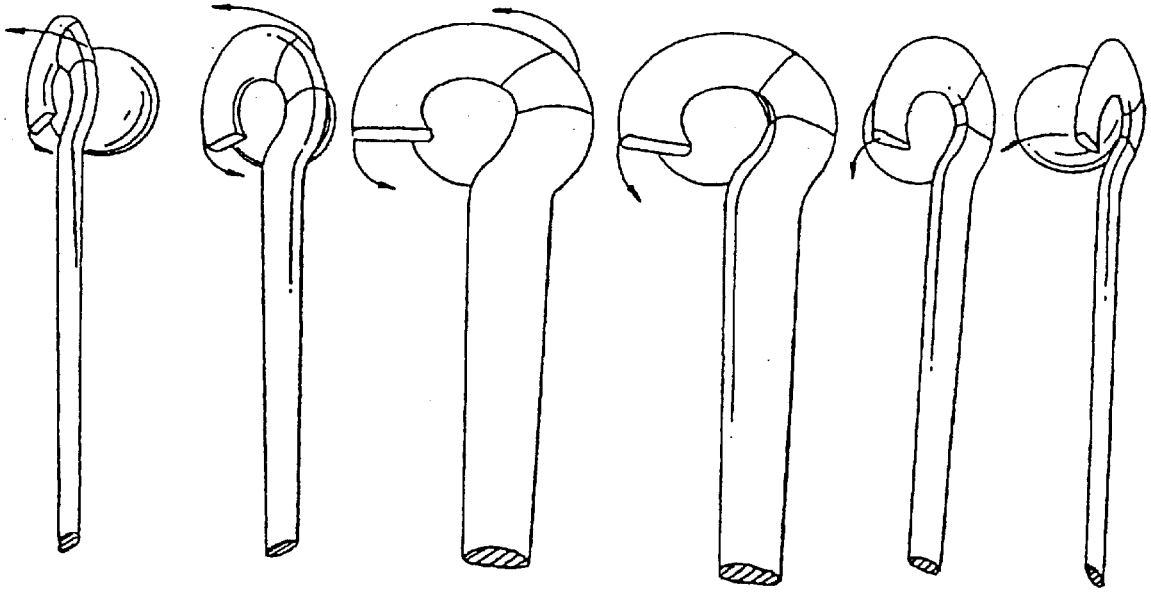
Figure 22:
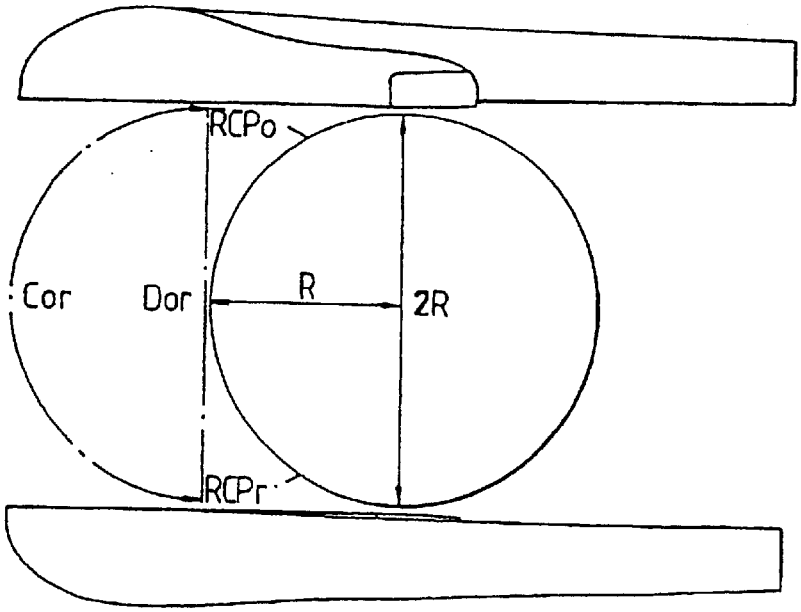
Figure 23:
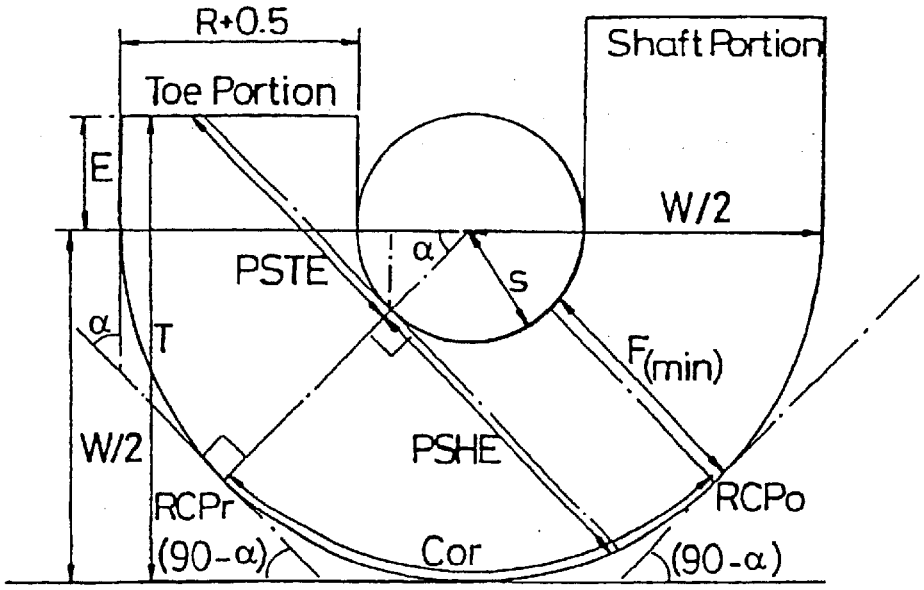
Figure 24:
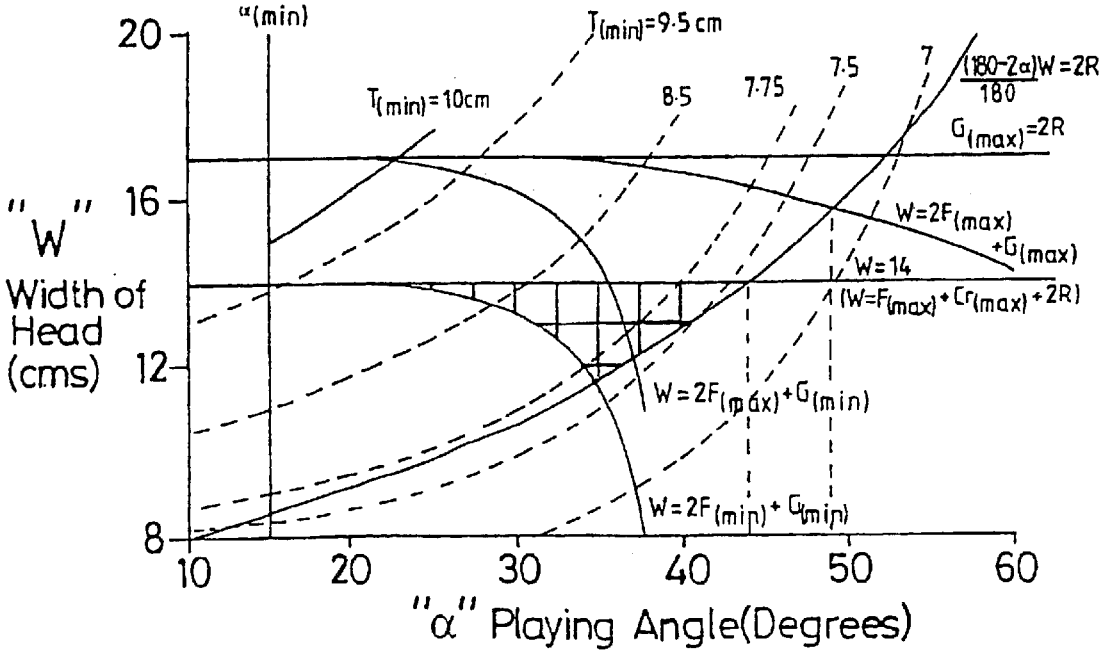
Figure 25:
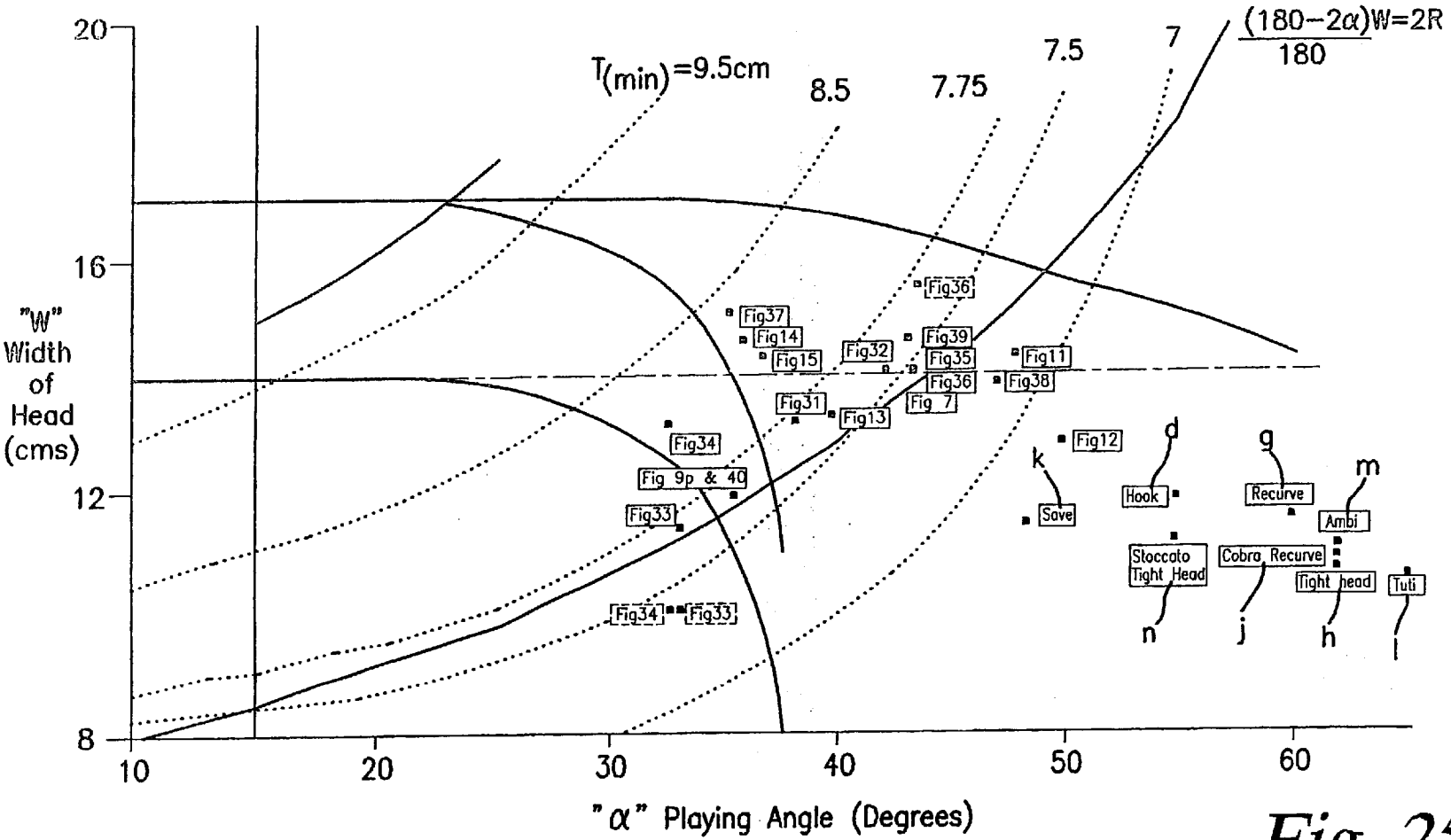
Figure 26:
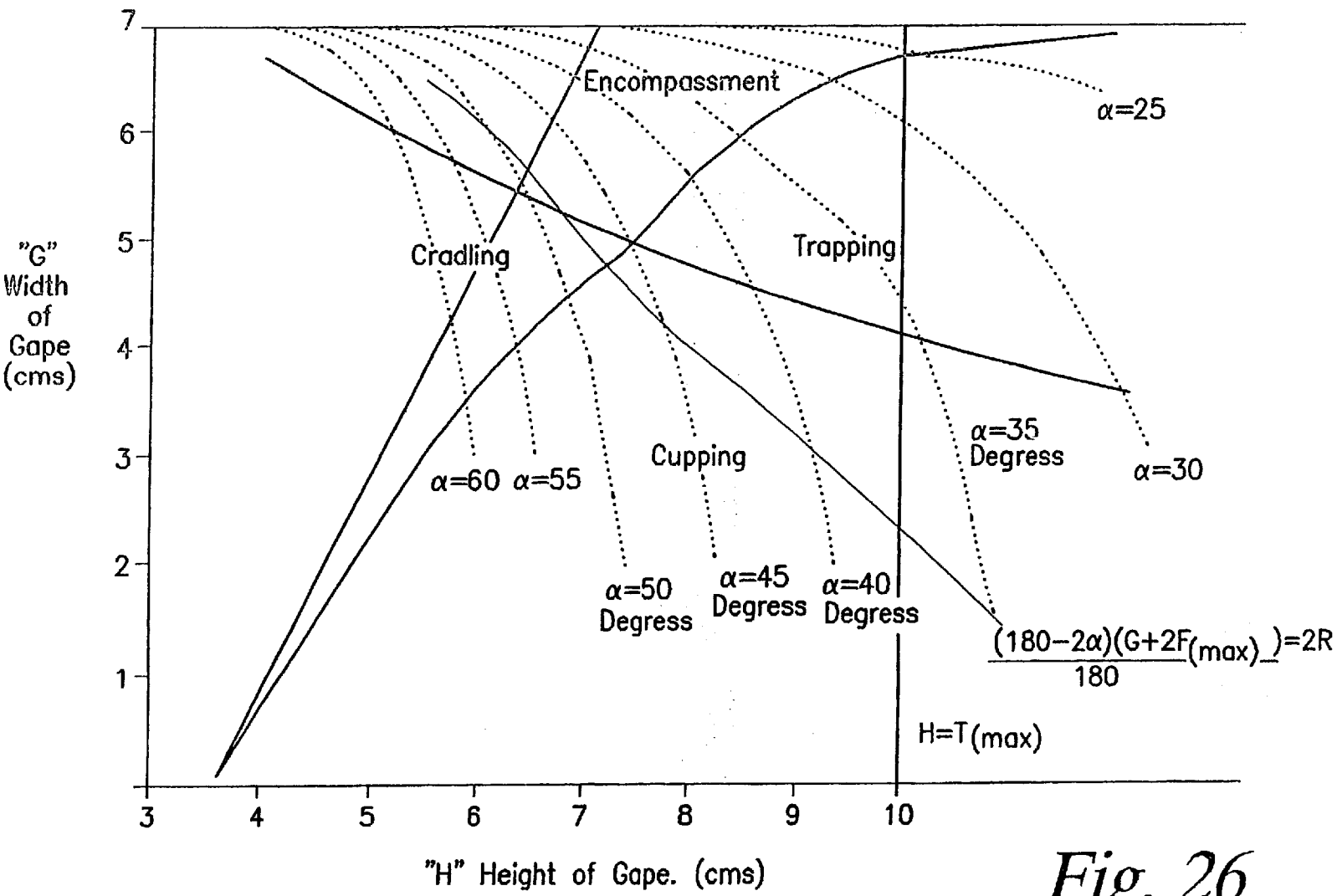
Figure 27:
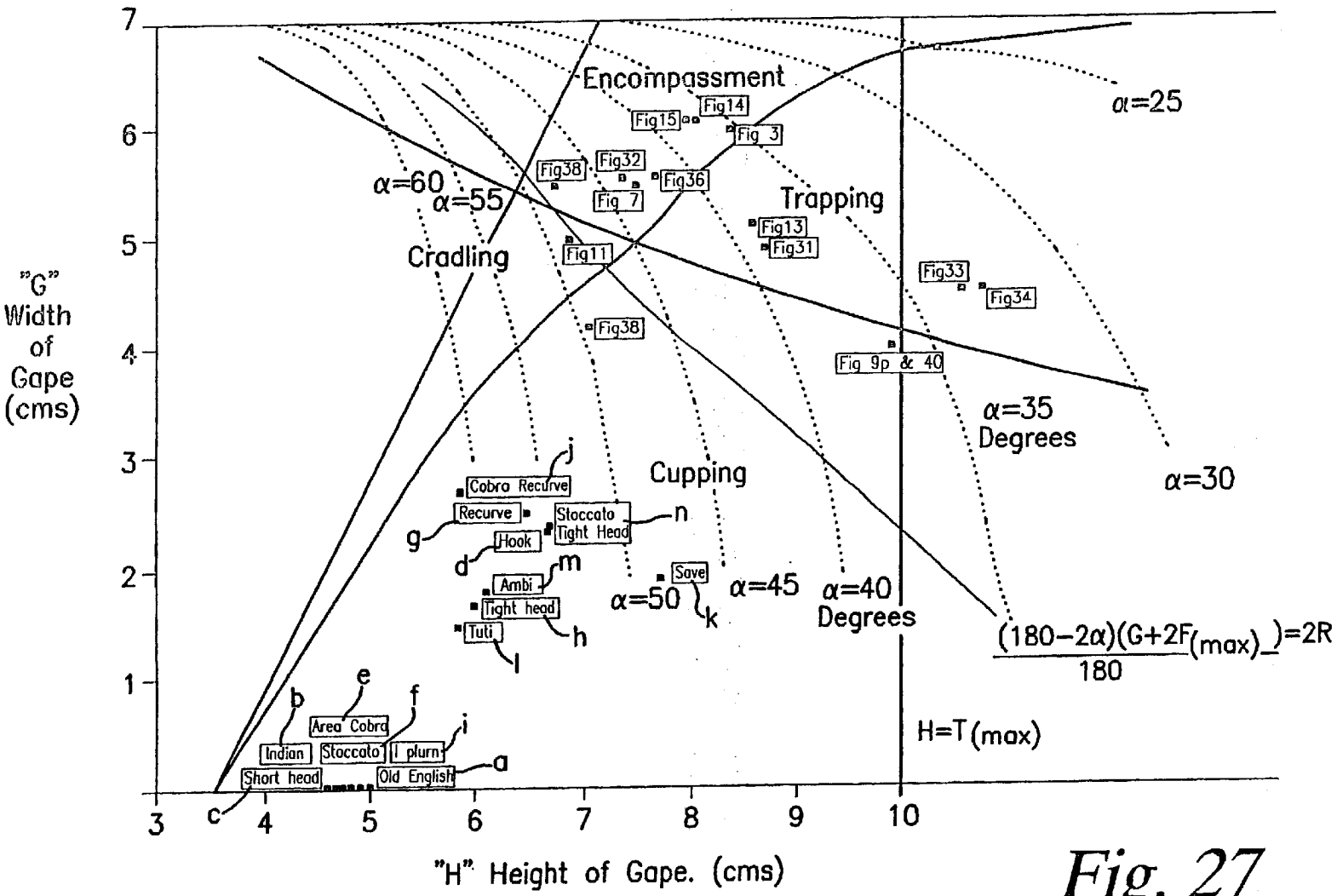
Figure 28:
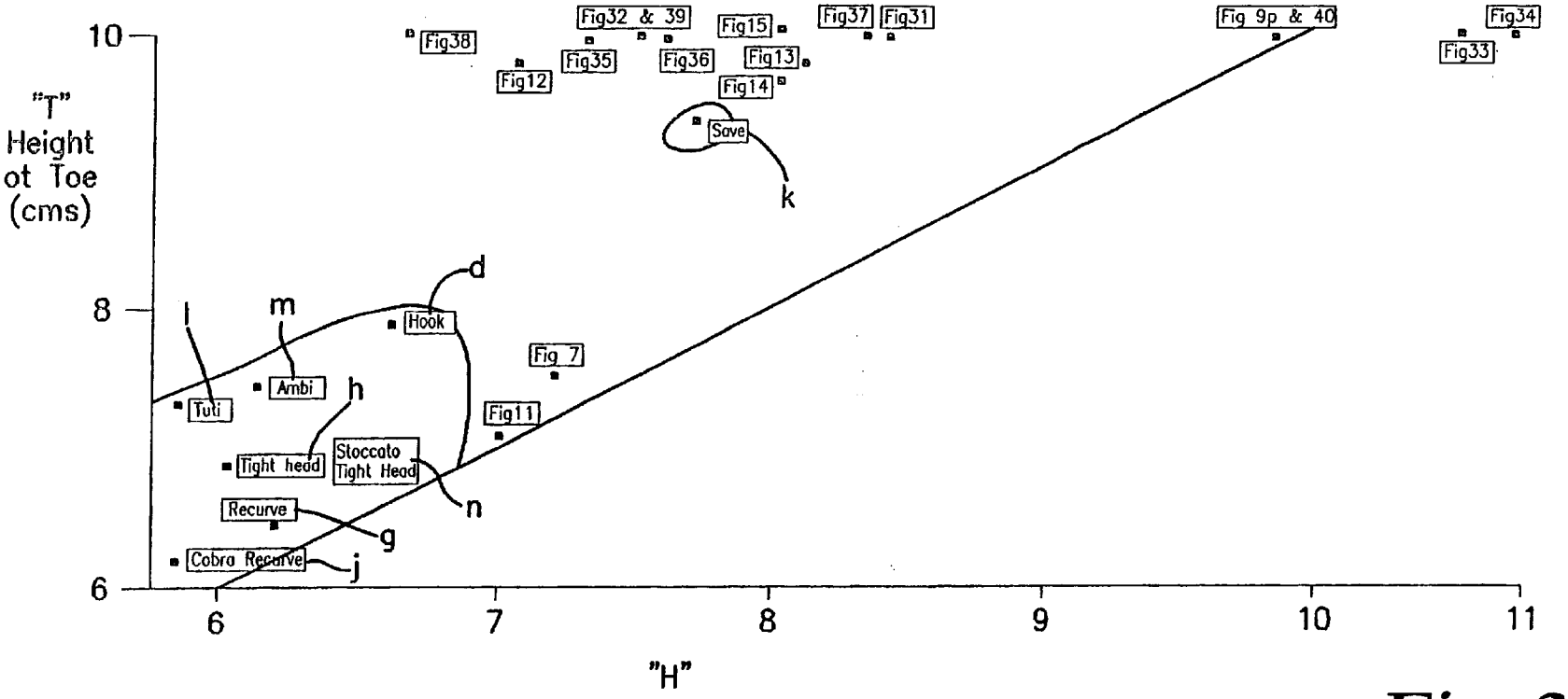
Figure 29A:
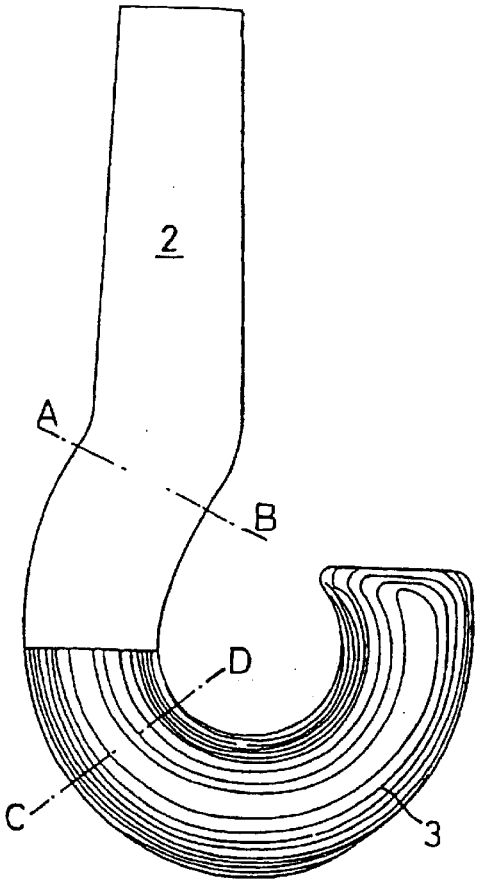
Figure 30A:
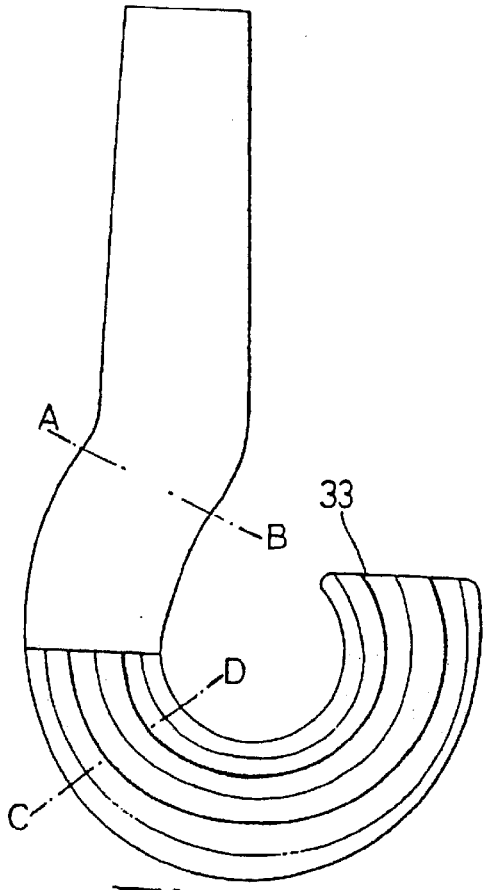
Figure 29B:
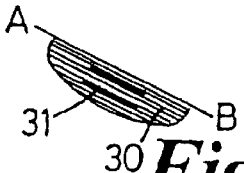
Figure 30B:
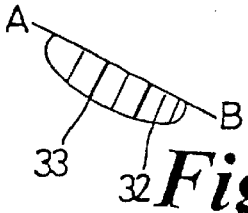
Figure 29C:
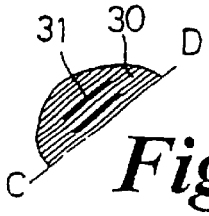
Figure 30C:
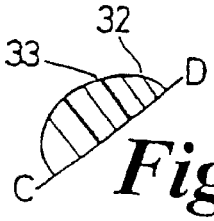

FIGS. 7(*a*) and (*b*) are views on the back of the lower portion and the whole of a stick in accordance with this invention;

FIGS. 8(*a*) and (*b*) are views on the back of the lower portion and the whole of a stick in accordance with this invention;

FIGS. 9(*a*) to (*p*) are views representing prior art sticks ((*a*) to (*n*)), and sticks in accordance with this invention ((*o*), (*p*));

FIG. 10 shows, in a perspective view from above, and a side view, a stick exhibiting a dragging effect;

FIG. 11 shows, in a perspective view from above, and a side view, a stick exhibiting a cradling effect;

FIG. 12 shows, in a perspective view from above, and a side view, a stick exhibiting a cupping effect;

FIG. 13 shows, in a perspective view from above, and a side view, a stick exhibiting a trapping effect;

FIG. 14 shows, in a perspective view from above, and a side view, a stick exhibiting an encompassment passment effect;

FIG. 15 shows, in a perspective view from above, and a side view, a stick exhibiting an absolute encompassment effect;

FIGS. 16 and 17 are schematic views of the geometry of the ball and stick;

FIG. 18 is a graph of gape (G) vs. gape height (H), indicating various desired parameters;

FIG. 19 is a graph similar to FIG. 18, but with additional desired parameters;

FIG. 20 is the graph of FIG. 19, with various sticks according to the prior art and various in accordance with the invention plotted;

FIG. 21 is a diagram representing circulation from an open stick playing position (far right) to a reverse stick playing position (far left);

FIG. 22 is a schematic view from above of the geometry involved in circulation from the open stick playing position to the reverse stick playing position;

FIG. 23 is a detailed view of the front of the head of a hockey stick identifying various components and measurements referred to herein; is FIG. 24 is a graph of width of head (W) vs. playing angle ($\alpha$);

FIG. 25 is the graph of FIG. 24 but with various prior art sticks and various sticks in accordance with the invention plotted;

FIG. 26 is a further graph of gape (G) vs. gape Height (H) similar to FIGS. 18 to 20, with additional criteria indicated;

FIG. 27 is the graph of FIG. 26 with various sticks according to the prior art and various in accordance with the invention plotted;

FIG. 28 is a graph of height of toe (T) vs. height (H) of gape, for various sticks according to the prior art and various in accordance with the invention plotted;

FIGS. 29(*a*), (*b*), and (*c*) are views on the back of the lower portion of a hockey stick in accordance with this invention, and on section lines AB, and CD respectively;

FIGS. 30(*a*), (*b*), and (*c*) are views on the back of the lower portion of a hockey stick in accordance with this invention, and on section lines AB, and CD respectively.

FIGS. 31–40 are views similar to FIGS. 7 and 8, but showing other embodiments of sticks in accordance with the present invention.

DETAILED NOMENCLATURE AND GEOMETRY

Figure 3:
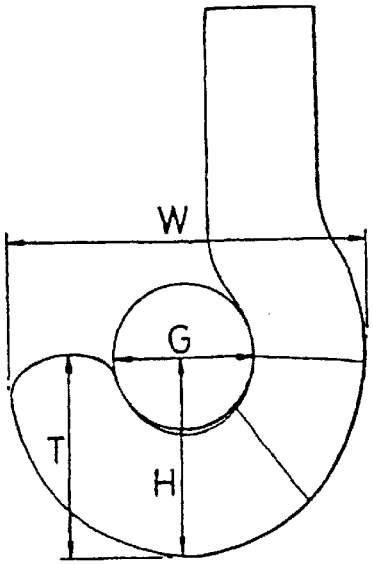
FIG. 3 is a view an the front of the lower portion of a hockey stick of this invention with an enlarged head.
Figure 5:
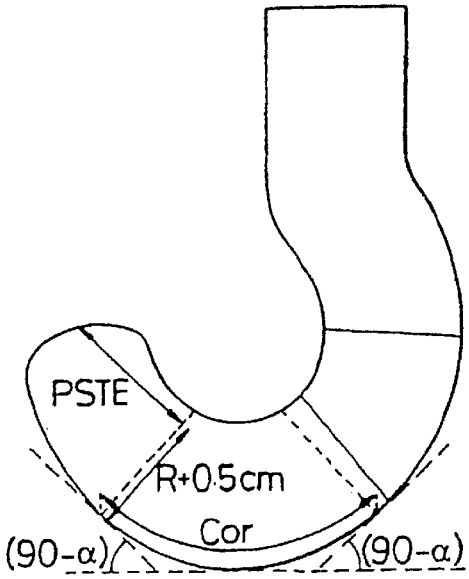
FIG. 5 is a view on the front of the lower portion of a hockey stick similar to that of FIG. 3.
Figure 4:
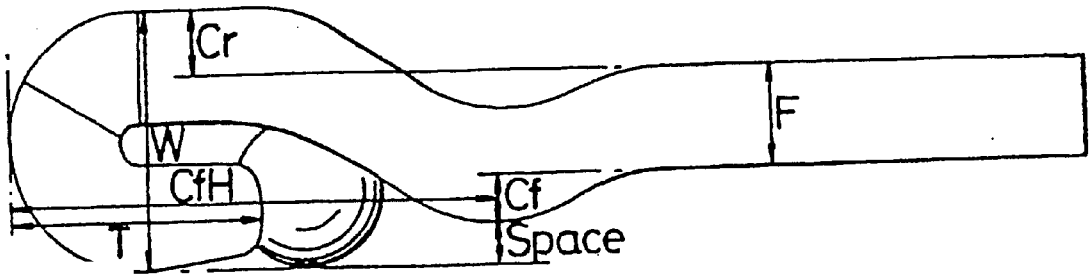
FIG. 4 is a view on the back of the lower portion of a hockey stick in a reverse stick block.

In this description I refer to a number of measurements in the stick namely the gape (G), the height of gape (H), the width of head (W), the height of toe (T), the forward displacement (Cf) and the rearward displacement (Cr) all of which can be measured directly from the face of the stick and are represented in FIGS. 3 and 4. Two further measurements, namely the circumference of rotation (Cor) and playing surface toe extension (PSTE), may only be measured knowing G and H and then via outline drawings, and both are represented in FIG. 5.

Broadly speaking, the Gape circles are notional circles that lie between and are not crossed by the inner facial edge of the head and/or shaft. Each circle should make contact with the inner facial edge at no less than two points that subtend an angle at the centre of the circle greater than 90° and preferably at least 180°. If the radially inner part of the playing surface of the stick should be chamfered or routed to provide a seat to receive a ball, the playing surface of the stick is deemed to end at the change in profile on the front part of the stick caused by chamfering or routing, and the chamfered or routed region is ignored. In such sticks the gape dimension is measured between opposite inner edges of the playing surface. The subtended angle should be measured from the highest contact point on the shaft or shaft side of the head, downwardly towards the head and back up to the furthest contact point on the toe or toe side of the head about the centre of the gape circle. Gape circles that have a diameter greater than 7 cm (the diameter of the ball) are excluded from consideration, and where no other gape circles less then 7 cm diameter can be defined there is considered to be no gape. Where contact on the right hand side of the gape circle is made only with the toe (i.e. past the last inflexion point on the inner edge before the convexly curved edge of the toe) the catching action produced will be of a dragging type (as herein defined) and hence such gapes are disregarded (with the exception to be described below), and for this purpose another gape circle should be sought. However where right side contact is provided only by the toe but a rearward curve exists in the shaft which provides left hand side contact between the shaft and ball above the centre of the gape circle, which in so doing subtends an angle between the furthest contact points of at least 180°, such gape circles can be counted.

In most cases the centre of the gape circle will lie below the highest extent of the toe; where it does not the highest contact point on the toe side of the head should subtend an angle about the centre of the gape circle of 50° or more measured anticlockwise from a vertical axis passing through the centre of the gape circle. Thus sticks in which the tangent to any part of the inner edge of the toe side of the head is inclined to the horizontal by greater than 50° can legitimately demonstrate a gape circle having a centre which is higher than the toe height (provided the gape circle doe not contact the toe itself except where a rearward curve in the shaft provides contact which subtends greater than 180° with the point of contact with the toe).

The gape (G) is the diameter of the gape circle.

The height of the gape (H) is the vertical distance from the ground to the centre of the gape circle when the head of the stick is in contact with the ground and the handle is held vertically.

In considering the aspects of this invention it will be noted that a stick may have several or a continuum of gapes, of which the most important are "High G", "Low G", and "Big G", being the diameter of the gape circles with the greatest gape height (H), the least gape height, and the greatest diameter, respectively. In any sticks, two or all three of these may coincide.

Likewise each gape circle selected will have a height (H) and so numerous configurations of (G) and (H) may exist, but sets of values for a stick may be precisely and accurately determined, and where appropriate the sets of values defining (G) and (H) for a stick may be analysed in turn. FIGS. 7 and 8 illustrate different gapes and corresponding measurements of (G) and H; in each case the higher circle shown would usually be disregarded because of lack of right sided contact with the head.

The width (W) is the greatest horizontal distance across the face of the stick between the outer extremity of the shaft or shaft side of the head and the outer extremity of the toe or toe side of the head when the base of the head of the stick is in contact with the ground and the handle held vertically.

The height (T) of the toe is the vertical distance from the ground to the highest part of the toe or head when the base of the head of the stick is in contact with the ground and the handle is held vertically.

Referring now to FIG. 4, the forward displacement (Cf) is the generally horizontal distance perpendicular from a line of continuation of the upper part of the inner edge 5 of the shaft and the furthest point of displacement of the inner edge 5 of the shaft towards the toe which results from a forward curve. Cf is usually zero.

The rearward displacement (Cr) is the generally horizontal distance perpendicular from a line of continuation of the upper part of the outer edge 6 of the shaft 2 and the furthest point of displacement of the outer edge of the shaft away from the toe which results from a rearward curve. Cr is often zero.

From G and H a further value known as the gape playing angle ($\alpha$) may be calculated. This is the angle of inclination at which the handle of the stick needs to be inclined to the ground when held face pointing down, with the lowermost part of the outter edge in contact with the ground, to bring a section of the ball firmly into the gape circle: $\alpha$ may typically be from 30° to 60° and is unique for a particular gape/gape height arrangement.

Figure 6:
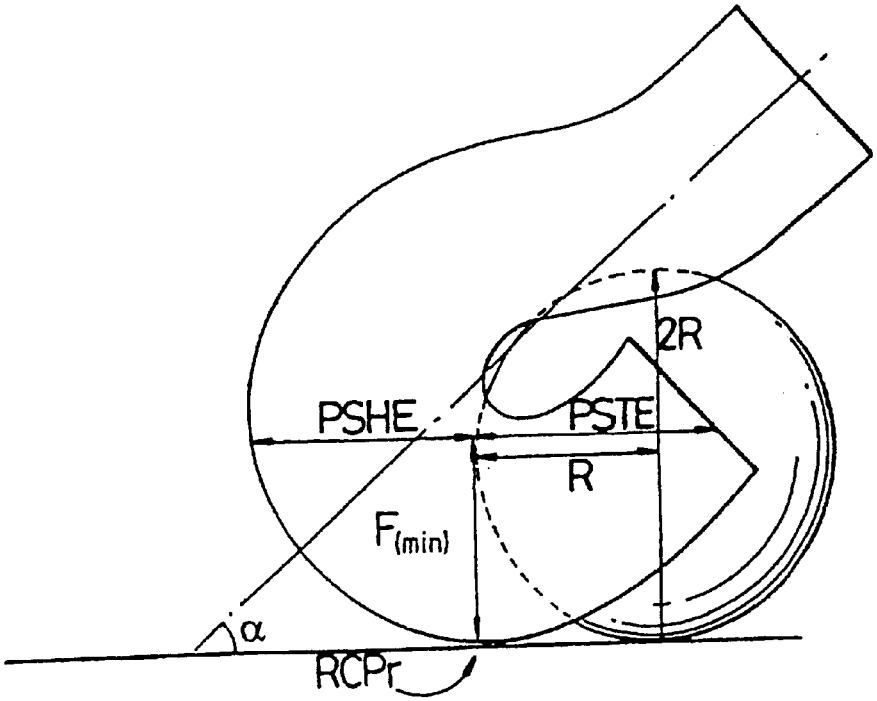
FIG. 6 is a view on the back of the lower portion of a hockey stick, illustrating the parameters PSHE and PSTE.

Referring to FIGS. 5 and 6, once the gape playing angle ($\alpha$) has been determined it is possible to measure two further important factors, the playing surface toe extension (PSTE) and the circumference of rotation (Cor). The reverse stick rotational contact point (RCPr), as demonstrated in FIG. 6, is the contact point of the stick with the ground when the stick is held at the gape playing angle ($\alpha$) in the reverse stick position. The open stick rotational contact point (RCPo) is the equivalent point on the open stick.

The playing surface toe extension (PSTE) is the distance, parallel to the ground but at a height of 4 cm above the ground, that the toe extends past the RCPr.

The circumference of rotation (Cor) is the distance, measured around the outside of the head, between the RCPr and the RCPo, i.e. the length of the surface in rolling contact with the ground as the stick is twisted from open stick to reverse stick when held at the gape playing angle $\alpha$.

I have conducted an extensive analysis of the dynamics of hockey stick and ball interaction and have discovered two predominant effects which influence holding and control of the ball by the stick and the gape circle. I have termed these effects "riding-over" and "squeezing out".

Any means of manoeuvring the ball in the gape circle requires a horizontal force, parallel to the ground, to be applied to the ball. If the force applied to the ball is purely horizontal then the ball will roll freely in the direction implied by the stick. However the force on a ball is rarely applied purely horizontally when catching the ball and in general the force includes downward as well as lateral components. The downward force gives rise to friction which can be problematic, as discussed below.

When a substantial element of friction occurs and the force from the stick is applied at a high angle from the centre of the ball the stick may ride over the ball leaving it behind. Conversely if the force is applied at a generally low angle to the ball the pressure applied to drive the ball through the frictional resistance may result in the ball being squeezed out in an uncontrolled fashion when it does eventually move.

The sticks that exhibit this "catching" effect can initially be subdivided into four types, those that exhibit both riding-over and squeezing out, those that exhibit one or the other and those that exhibit neither. A fifth type can also be identified where the major proportion of the gape circle lies above the highest extremity of the toe and contact between ball and stick is restricted to two lateral areas on the shaft and toe. I have named these different means of catching; Encompassment, Cradling, Trapping, Cupping and Dragging, and these are discussed in greater detail below.

Dragging

In this method the ball is provided with a lateral force from behind by the toe of the stick and a guiding force from the left by the inner edge of the shaft as demonstrated in FIG. 10. However little if any guiding force is provided to the right of the ball and no restraining force is present to keep the ball in position. The action is generally performed with the edge of the toe and the edge of the shaft, there being no contact with the inner edge or (ace of the head. This method can commonly be performed with state of the art sticks and does not form part of the invention, except where a rearward curve in the shaft is present which provides for contact between the gape circle and stick spanning 180° or greater thereby providing right sided guiding forces and a rearward restraining force.

Cradling

In this method the ball is provided with a horizontal force from behind and with guiding forces from the edges of the limbs of the head, simultaneously from the left and right of the ball as shown in FIG. 11. The most important feature is that the lowest point of contact between stick and ball is below the hall-height line on the ball. The bulk of the ball thus prevents the head from climbing above the ball and as such this method has few if any problems with riding-over. Nevertheless the lack of a restraining force from the front results in problems with squeezing out particularly where any attempt is made to change the direction of movement of the ball.

Cupping

Here, when the gape arrangement is used with the head in contact with the ground, all of the forces applied to the ball act upon the upper rear quarter of the ball as shown in FIG. 12. As such the horizontal driving force is a resolved element of these forces and is of similar magnitude to the downward resolved element. Hence the frictional resistance offers considerable opposition to the driving force, resulting in the possibility of both riding-over and squeezing-out. The user may overcome one or the other problem by raising or lowering the handle. Raising the handle will free the ball helping it roll and preventing riding-over. Lowering the handle will force the head off the ground and subsequently the gape circle may pass the highest point on the ball, thus providing a backwards restraining force to prevent squeezing-out, which I term "elevated encompassment". Elevated encompassment suffers not only from requiring a lower angle of play making control uncomfortable and more difficult but it also suffers from having no contact with the ground, which normally provides the user with a guide to ensure correct positioning and a consistency of playing effect in the process. The greater the attempt to avoid either riding-over or squeezing-out, the more the other is encouraged. The user of sticks with such gape arrangements will require a reasonably high level of skill to judge the accurate angle of play required by a ball on any particular surface and good reactions to assist in overcoming misjudgments or changes in surface friction. Obviously the closer such arrangements are to trapping, cradling, or encompassment arrangement the less the required skill to provide accurate play.

Trapping

In these arrangements the gape circle is provided so that whilst the head of the stick rests upon the ground the highest point of the ball falls just within the gape circle as shown in FIG. 13. Hence these sticks allow a backward constraining force to be applied in such embodiments that have a curve in the shaft or a recumbent part to the toe. Such a force reduces or eliminates the problem of squeezing out. Nevertheless the general application of the forces applied in these arrangements are in the upper section of the rear quarter of the ball producing a substantial downward force and a considerably less substantial horizontal driving force. Hence these arrangements may exhibit problems with riding over. In such circumstances this may be ameliorated by raising the handle which would result in loss of restraining control. On the other hand sticks of such arrangements can provide an encompassing effect when tilted to the side, or another lesser angle of the ball. At these inclinations, assuming a substantial tee has been provided with a recumbent element and a curve has been provided in the shaft, the Height of the Gape effectively becomes the width of the toe or shalt plus half the gape. This reduced height allows forces to be applied from below the ball whilst a restraining effect is provided from above by either the shaft or toe opposite. As such a "mock encompassment" effect is produced. The manoeuvrability of the ball may be hampered by the problems experienced when the ball is played straight on, nevertheless the configuration does provide benefits.

Encompassment

In such arrangements the stick meets the ball both below the half height line and past the median line and as a result the skill requirement of the player is substantially reduced as the ball is also comfortably retained within a combination of left and right sided guiding forces (see FIG. 14). Where a recumbent element to the toe and a curve to the shaft are provided, these provide further restraining forces acting backwards from the left and right sides. As such the ball can be fully encased and still be allowed to roll freely when encompassed by the head as in a ball and socket joint. Such arrangements are termed "absolute encompassment", see FIG. 15. In its lesser embodiments the arrangements of encompassment, as presented in FIG. 14, utilise the curve of the shaft to provide a left sided restraining force only.

I have subjected these arrangements to geometrical analysis to investigate their characteristics in greater detail. I would however emphasize that the geometric analysis below indicates optimal characteristics of preferred embodiments of the sticks, but that the invention extends broadly to sticks which, whilst not possessing one or more of the ideal characteristics set out below, still fall within the scope of the Claims, and as such possess unique beneficial and distinctive properties compared to prior art sticks.

Referring now to FIGS. 16 and 17, these represent line drawings of the head and toe portion of a hockey stick with the gape circle catching the ball. It is possible to show from such diagrams that $$H \sin \alpha - (R \cos(\sin^{1}(G/(2R)))) \cos \alpha - R \qquad \text{Eqn (1)}$$

$$\alpha = \sin^{-1}(R/(H^2 + (R \cos(\sin^{-1}(G/(2R))))^2)^{0.5}) + \tan^{-1}((R \cos(\sin^{1}(G/(2R))))/H) \qquad \text{Eqn (2)}$$

where $\alpha$=Gape playing angle of stick relative to ground
H=Height of Gape
R=Radius of Ball
G=Gape dimension.

To facilitate absolute encompassment and alleviate squeezing out, a recumbent element may be provided in the toe to hold the ball firmly. An effective recumbent element would reach approximately a quarter of the gape diameter (G) above the centre of the Gape circle. To fit within the toe such a distance should be less than the height (T) of the toe. Hence to facilitate absolute encompassment:

$$T > H + G/4 \qquad \text{Eqn (3)}$$

where H=Height of Gape.

To allow for the stick to be able to hit, stop, push, dribble, etc. the ball, the minimum facial width $F_{(min)}$ (i.e. the minimum width of face that will allow the ball comfortably to be played) should be no smaller than the height of the centre of the ball (R). It is wise to provide an allowance for wear and error and in general $F_{min}$>R+0.5 cm. The space below the gape available to accommodate the face is the height of the gape (H) less half the gape diameter (G); (H−G/2). Hence in all aspects to accommodate an effective face:

$$H - G/2 > R \qquad \text{Eqn (4)}$$

The effects of riding-over can be alleviated if the base of the gape is applied to the ball below the half height line an the ball, that being R above the ground. By geometry, the base of the gape can be shown to be applied at a height from the ground of ((H−G/2)sin $\alpha$). Hence where $$(H - G/2) \sin \alpha < R \qquad \text{Eqn (5)}$$

riding over can be alleviated and cradling or encompassment can be achieved. Where however the location of the base of the gape circle is greater than 5 cm ($F_{(max)}$)(maximum allowable facial width) up the stick it is impossible for there to be contact between the inner edge of the head and the base of the gape circle In these circumstances the lowest contact point of the gape circle with the inner edge of the head must lie below the half height line to ensure riding-over is alleviated. The estimated location of this point is $G^2/4(H-F_{(max)})$ below the centre of the gape circle and hence through the formula:

$$R>(H-G^2/4(H-F_{(max)}))\sin\alpha \quad \text{Eqn (6)}$$

the ability to overcome riding-over can be determined for these higher values of gape height.

To alleviate squeezing out the toe should provide a recumbent section that passes the median line on the ball. To do so the top of the gape circle must pass the median fine on the ball. The distance from the base of the head to the top of the gape circle is half the gape diameter plus the height of the centre of the gape (H+G/2). By geometry it can be shown that the distance up the face to the median line of the ball is (L tan α+H), where L is the perpendicular distance from the face of the stick to the centre of the ball. Hence to overcome squeezing-out and allow for trapping or encompassment:

$$H+G/2>L\tan\alpha+H\therefore G>2L\tan\alpha \quad \text{Eqn (7)}$$

Further to alleviate squeezing-out and provide absolute encompassment the top of the toe must pass the median line an the ball so as to allow for a gape to be provided at this position. Hence to provide absolute encompassment:

$$T>L\tan\alpha+H \quad \text{Eqn (8)}$$

No gape can be provided if the height of the toe (T) is less than the height of the base of the gape circle H−G/2. Hence to provide any catching effect:

$$T>H-G/2 \quad \text{Eqn (9)}$$

For the gape to be effective in trapping the ball it cannot exceed the diameter of the ball:

$$G<2R \quad \text{Eqn. (10)}$$

These requirements can be represented graphically through linear programming techniques. Plotting G versus H in FIG. 18 we can initially show the realms of the four primary means of catching are initially demonstrated by plotting the inequalities (H−G/2)sin α<R (Eqn (5)) and R>(H−G²)4(H−$F_{(max)}$))sin α(Eqn (6)) which define free flow movement and overcome riding-over along with G>2L tan α(Eqn (7)) which defines an applicable restraining force and overcomes squeezing-out.

To this diagrammatical study the features of maximum gape (G<2R) (Eqn (10)), the minimum toe length (T>H−G/2) (Eqn (9)), and minimum beneficial face (H−G/2>R) (Eqn (4)) can be added easily as in FIG. 19 with an understanding that the rules provide for a ball of radius approximating 3.5 cm and limit the toe to 10 cm. At FIG. 20 a range of prior art sticks are plotted on the chart, together with embodiments of this invention, from which it will be seen that all the represented prior art sticks have gapes (G) less than 3 cm whilst the embodiments of this invention have gapes (G) greater than 3 cm. I will also be seen that all the prior art sticks lie in the lower portion of the lower right hand quadrant labelled "cupping", whereas the majority of embodiments of this invention lie in the upper left and right quadrants labelled "encompassment" and "trapping" respectively.

The features of T>L tan α+H (Eqn 8)), and T>H+G/4 (Eqn (13)) both relate to the provision of absolute encompassment. To achieve absolute encompassment a stick must fulfil all the features of encompassment and these two latter features. It can be shown from such a linear programming investigation that to achieve absolute encompassment the Gape Height may not exceed 8.5 cm and the height of the toe must be at least 8 cm.

The preferred sticks of this invention show a further characteristic which I have termed "circulation", this effect is made possible by the ability of the stick to hold the ball in a catching effect with the ball lying between the shaft and toe of the stick whilst the head of the stick is held face down. If the stick is rotated from reverse to open stick and vice-versa around the ball, as shown in FIG. 21, with the head in contact with the playing surface, the stick is not grounded on the ball whilst passing the face down position and further provides a limb of the head of the stick adjacent the ball at each end of the action with which to comfortably play the ball. What is more these embodiments do not require the handle to be raised, lowered or moved laterally in any combination to allow the circulation action to clear the ball, nor does the circulation action cause the ball to be moved by the head as it rotates found its own outer edge.

The ability of the stick to provide the circulation effect can be identified through a series of measurements and calculations taken from the face of the slick. The measurements "G" and "H" allow the reader to determine the gape playing angle "α". From "α", the circumference of rotation ("Cor") and the playing surface toe extension ("PSTE") can be measured or calculated from the face of the stick as shown in FIG. 5.

From FIG. 22 it is clear that the entirety of the semicircle of rotation ("Cor") (i.e the notional line of contact traced out by rolling contact of the outer edge of the head during circulation) must lie behind the ball to prevent collision of the stick and ball in the circulation process.

FIG. 6 demonstrates that the distance 'PSTE' needs to be at least as long as the radius of the ball to provide a playing surface to meet the ball at the reverse stick end of the circulation process. Producing a stick with a PSTE of close to 3.5 cm would require absolute accuracy of play and provides no margin for error, and so a more reasonable margin for error might be incorporated through a PSTE of 4.5 cm.

FIG. 22 also demonstrates how the diameter "Dor" of the semicircle of rotation must be greater than the diameter of the ball to prevent the circulation process ending in collision between toe and ball. Thus "Cor" must be greater than the radius of a ball multiplied by the π, and so Cor must exceed 11 cm to clear the ball in circulation. Once the diameter of rotation exceeds the diameter of the ball, a larger air space will exist between the ball and the stick at each end of the action. A small air space is desirable to alleviate small inaccuracies in movement but a large air space presents the stick at too large a displacement from the ball to support effective and prompt control of the ball in the dribbling action. Hence a value of 'Cor' marginally above 11 cms is beneficial.

Where the centre of the gape is substantially offset from the spatial axis, much as in a dragging action during any attempt at the circulation process the toe will be driven into the ball on the reverse slick side and the shaft left at an unplayable distance from the ball on the open side. Hence circulation would seem impossible from the dragging position, which is a common means of catching in existing sticks.

FIG. 28 demonstrates how existing sticks all have their most effective gape circle arrangement located extremely close to or above the top of the toe. The further a stick lies above the line H=T (H=height of gape circle: T=Toe height) the greater the potential PSTE and the more valuable the circulation ability is likely to be. Hence for circulation:

$$H<T \quad \text{Eqn (11)}$$

As an alternative to measurement of the 'Cor' and 'PSTE' values, I use the simpler values of width of head 'W' and height of toe 'T' as shown in FIG. 3 to calculate an approximation of PSTE and Cor. The heads of most hockey sticks have an outer edge that approximates to a semicircular form or part thereof and, in such cases, the circulation potential (Cor) may be estimated from the width of the head (W) and height of the toe (T), using the value of the playing angle 'α' derived from 'G' and 'H'. FIG. 23 shows the basis of the calculations that define approximate values of 'PSTE' and 'Cor' in terms of 'W', 'T' and 'α'.

As previously shown, to achieve circulation, 'Cor' must be greater than π×R, which leads to the following approximation in the terms of gape playing angle (of and width of head (W) and radius of ban (R):

$$(180-2\alpha)W/180\sim<2R \quad \text{Eqn (12)}$$

This inequality is exemplified in FIG. 24 which also demonstrates the minimum height of toe $T_{(min)}$ required to produce a PSTE of 3.5 cms (i.e. typical ball radius) at any arrangement of 'W' and 'α', resulting from the approximation:

$$\bar{E}(t)\cong((W/2-F_{(min)})\sin\alpha+(T-W/2))/\cos\alpha \quad \text{Eqn (13)}$$

The $T_{(min)}$ value is the lowest value that could possibly work based on the appropriate W and α arrangement. However each of these represent a series of G and H arrangements all of which will have a toe height requirement greater than $T_{(min)}$ and in many cases substantially so.

FIG. 24 suggests that under the current rules, free circulation of the head around the ball requires a gape playing angle (α) less than 50°, a width of head (W) greater than 11.65 cm and a toe height (T) substantially in excess of 7.26 cm if a reasonable margin of error is to be provided for. However these factors are interrelated with greater gape playing angles (al requiring greater widths (W) and lower playing angles (α) requiring larger toe heights (T). The lowest head widths are achievable at approximately 35° of playing angle (α) and require a minimum toe height (T) of 7.65 cm. However small head widths (W) necessitate substantially reduced facial widths (F) to allow for the required gape (G) to be accommodated. Thus, widths (W) of less than 12.25 cm can only be achieved by substantially reducing the facial width (F) of the limbs of the head and subsequently detracting from the value of the resulting head shape.

In FIG. 25 the features of the embodiments of sticks of this invention are compared with those of the prior art. The head width basis of analysis is an approximation and as such sticks that possess substantial straight sections 22 as in FIGS. 33 & 34 which are angled to the vertical at a lesser angle than the playing angle(α), as determined by the gape (G) and gape height (H), can appear by calculation, using the width (W) of the head method described above, to provide circulation but in fact do not. FIG. 25 shows two locations for the sticks from FIGS. 33 & 34 based on the width estimation method (solid lines), and a more accurate calculation of their abilities (dotted fines). The greater the angle of such straight sections and the longer their length the greater the chance of the calculation proving inaccurate. Conversely sticks which are truncated on their outer edges above the rotational contact points RCPo and RCPr as in FIG. 36 may suggest via calculation that they do not possess a great enough width of head for circulation but in fact they are fully capable of performing the effect. Similarly FIG. 25 shows two values for the stick in FIG. 36. Hence it is much safer to measure the Cor accurately than to rely on the width measurement which is only provided as a rough guide.

In a generally semicircular head the width of the head (W) approximates to the gape (G) plus two times the width of the face (F).

$$W=G+2F \quad \text{Eqn (14)}$$

The width of the face (F) can reasonably be expected to vary between 3.5 cm and 5 cm ($F_{(max)}$). The lowest width (W) measurement is defined by the line 2R=(180−2α)W/180, the lowest possible gape (G) can be defined as no less than $W-2F_{(max)}$. Hence, as seen in FIG. 27, a new inequality can be introduced to our Gape/Height graph of 'Catching Means' which dictates the absolute maximum possible extent of circulation $$2R>(180-2\alpha)(G+10)/180 \quad \text{Eqn (15)}$$

Figure 1:
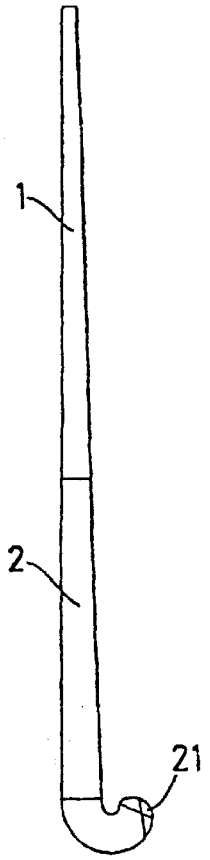
FIG. 1 is a back view of a hockey stick for identifying the various pans thereof.
Figure 2:
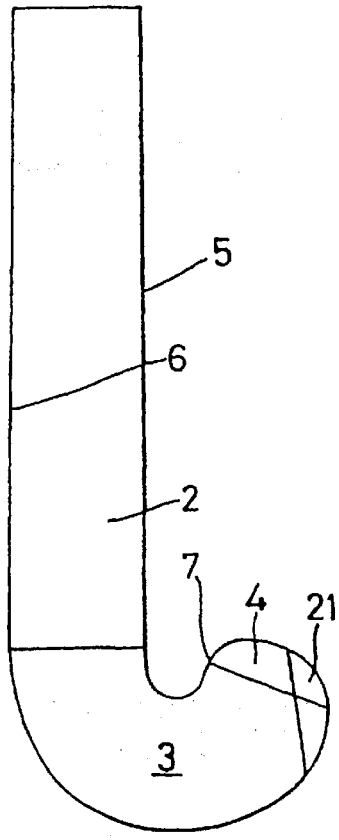
FIG. 2 is an enlarged view on the lower part of the stick of FIG. 1.

The inequality H<T (Eqn (11)) and this new inequality (Eqn (15)) are shown in FIG. 2. An investigation of this new graph shows that where the circulation feature is present, the Cradling field becomes very limited and the Cupping field is markedly reduced.

Widening the head or lengthening the toe may adversely affect the balance of the stick. This imbalance can be redressed by inserting a rearward curve in the shaft of the stick, which also allows for the provision of a shaft which contacts the gape circle above its centre, thus improving its ability to hold the ball in the gape circle.

Widened heads increase the chance of the ball passing beneath the shaft in a reverse stick block, and this too can be alleviated by introducing a rearward curve in the shaft.

FIG. 4 demonstrates that where:

$$F_{(max)}+2R>W-Cr-Cf \quad \text{Eqn (16)}$$

$F_{(max)}$=is the maximum allowable facial width, 5 cm

R=radius of ball

=width of head

Cr=rearward displacement as indicated on FIG. 4

Cf=forward displacement as indicated an FIG. 4 a ball will not pass beneath the stick when laid fiat on the reverse side.

As the width (W) approximates to the gape (G) plus two times the facial width (F), W≅G+2F (Eqn (17)), where no deviation in the shaft occurs it can thus be shown by substituting Eqn (17) into Eqn (16), that, $G<F_{(max)}+2R-2F$ ensures a successful reverse stick black facility. Where the facial width (F) in the head is minimised at 3.5 cm, an absolute maximum value of gape (G) of 5 cm can therefore be derived, above which a straight stick will prove incapable of presenting an effective reverse stick block. This is a substantial restriction upon the value of the features of catching and circulation, especially when it is considered that a more reasonable facial width in the head of say 4.5 cms would reduce the maximum gape compatible with a reverse stick block to 3 cms.

Hence as the sticks of this invention all incorporate heads of generally enlarged width, it is much preferred that the sticks also include a rearward curvature to provide a reverse stick blocking effect.

The catching and circulation effects introduced in the embodiments of the invention require a widened head and heightened toe, and this has the added benefit of an enlarged playing area. An enlarged playing area can accommodate inaccuracies of use by the player or slight vertical or horizontal deviations in movement of the ball without the ball passing the stick.

A further benefit of the enlarged playing area is that the stick has an improved lateral dimension or playing surface. When held in the open or reverse stick position with the handle at an inclination of approximately 45° to the ground, the length of the head parallel to the ground which could be used to stop the ball an the ground is known as the playing surface. The result of the substantial toe provided lo facilitate the catching and circulation effect subsequently results in an enlarged playing surface.

In providing for the circulation effect it is advantageous to centralise the gape as far as possible below the axis of the handle and above the lowest point of the circular element of the outer edge of the head (the end of the spatial axis). Hence in embodiments of this invention, the extended toe is preferably balanced about the axis of the handle and subsequently the provision of an extended playing surface and enlarged playing area do not unnaturally effect the balance or performance of the stick in rotation and in fact the end result is an improvement in the dribbling action.

Referring now to FIGS. 29 to 39, there are illustrated various embodiments of hockey sticks of this invention, each having a rearwardly curved shaft 2 to define a head with a generous gape (G) (as herein defined). In FIGS. 29(*a*) to (*c*) the head 3 is formed of a plurality of laminar elements 30 which extend in planes generally parallel to the playing surface of the stick. Selected laminar elements are cut away or recessed to allow reinforcing elements 31 to be inserted. The reinforcing elements 31 may typically be made of a reinforcing material such as carbon fibre, glass, or mineral fibre, or synthetic fibre material.

Referring now to FIGS. 30(*a*) to (*c*), in this embodiment the overall shape of the shaft 2 and the head 3 are similar to that of FIG. 29 but here the stick is made of laminar elements 32 which extend in planes generally perpendicular to the playing surface, generally following the line of the curve of the head. Between selected laminar elements 32 are interposed reinforcing elements 33 made of a reinforcing material similar to those listed in connection with FIG. 29.

FIGS. 29(*a*) to (*c*) and 30(*a*) to (*c*) also illustrate sticks in which the playing face, that is the face of the stick facing into the drawing as viewed, has an inclined or shallow conical profile wherein the typical angle of inclination of the playing surface to the plane of the drawing, which is vertical in FIGS. 29(*a*) and 30(*a*), lies in the range of from 5° to 20°. This can be seen more clearly in FIGS. 29(*b*) and (*c*) and FIGS. 30(*b*) and (*c*), in which the vertical plane of FIGS. 29(*a*) and 30(*a*) has been turned to be horizontal.

Figure 31:
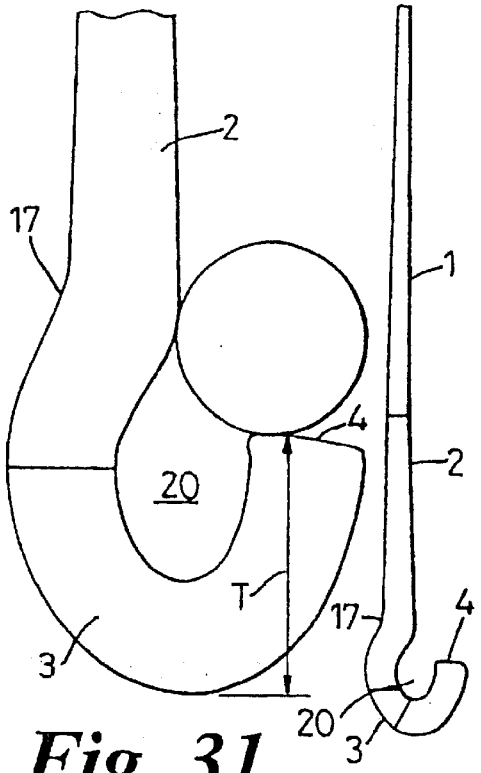
Figure 32:
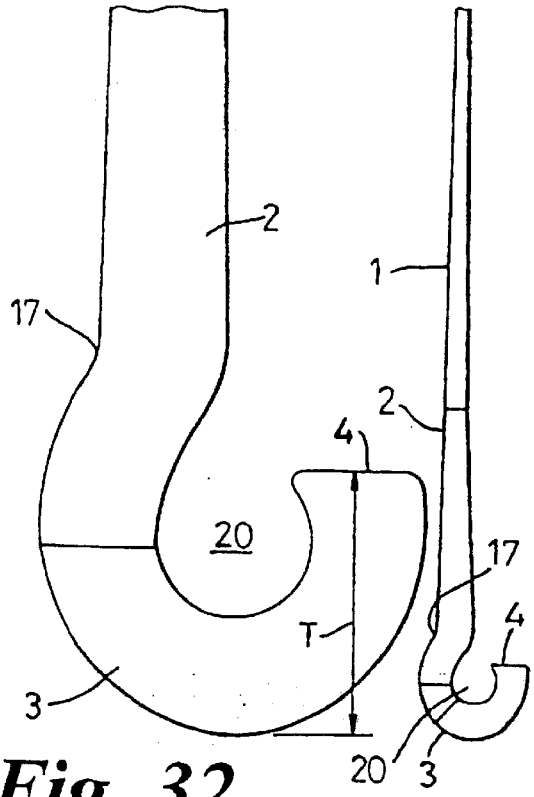
Figure 33:
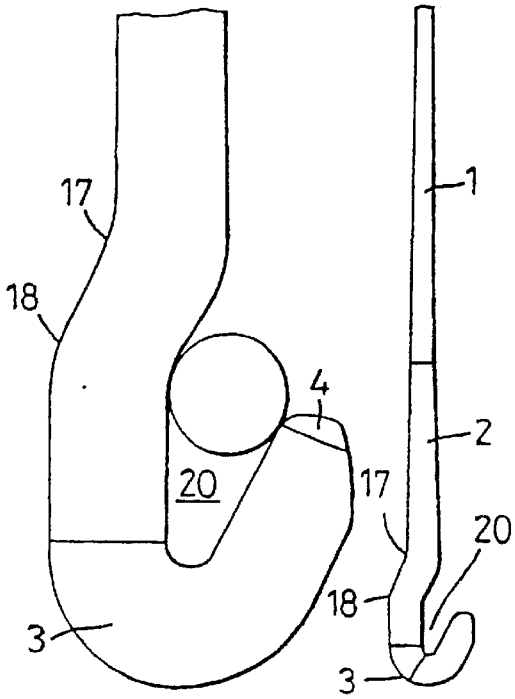
Figure 34:
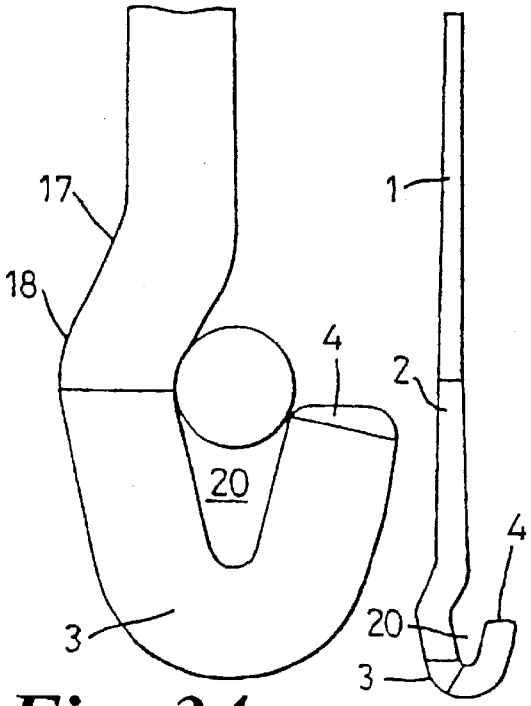

Referring now to FIGS. 31 to 39, it is emphasized that any dimensions are given by way of example only and are not intended to limit the invention. All of the embodiments illustrated have a shaft with a rearward curve 17. In FIG. 31 the gape 20 is of distended form and there is a large toe height (T). In FIG. 32 the gape 20 is more circular in nature. FIGS. 33 and 34 show v-shaped gapes 20 both having a forward curve 18 in the lower portion of the shaft, before it meets the head.

Figure 35:
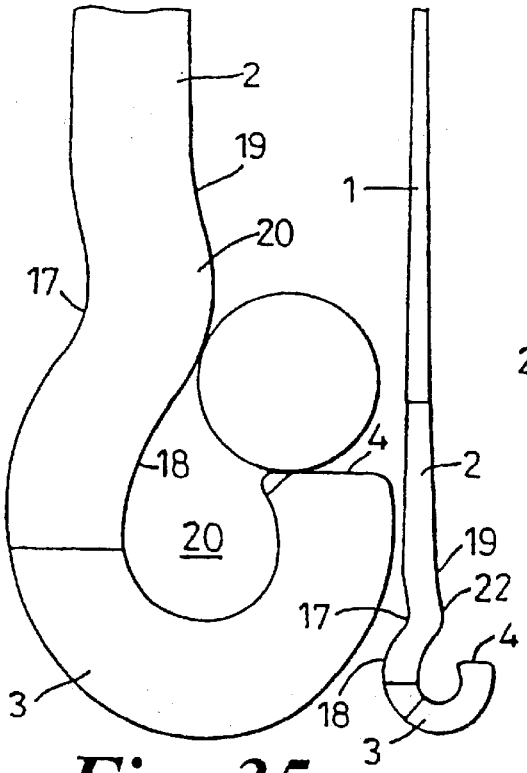
Figure 36:
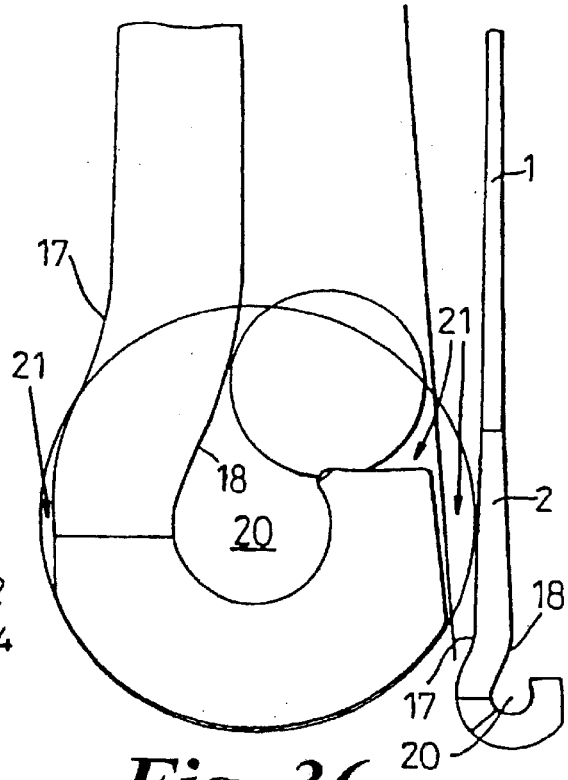
Figure 37:
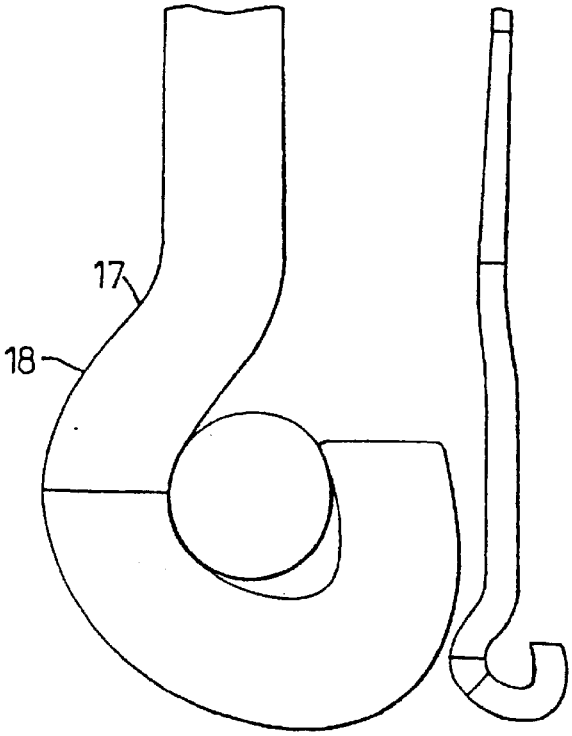
Figure 38:
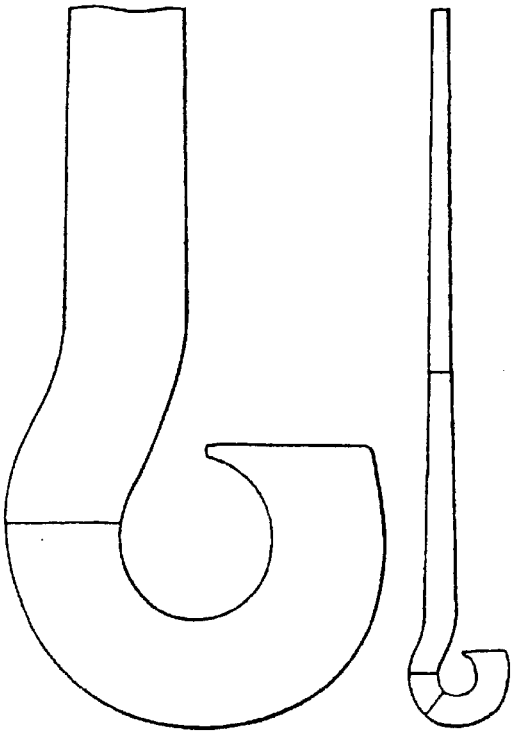
Figure 39:
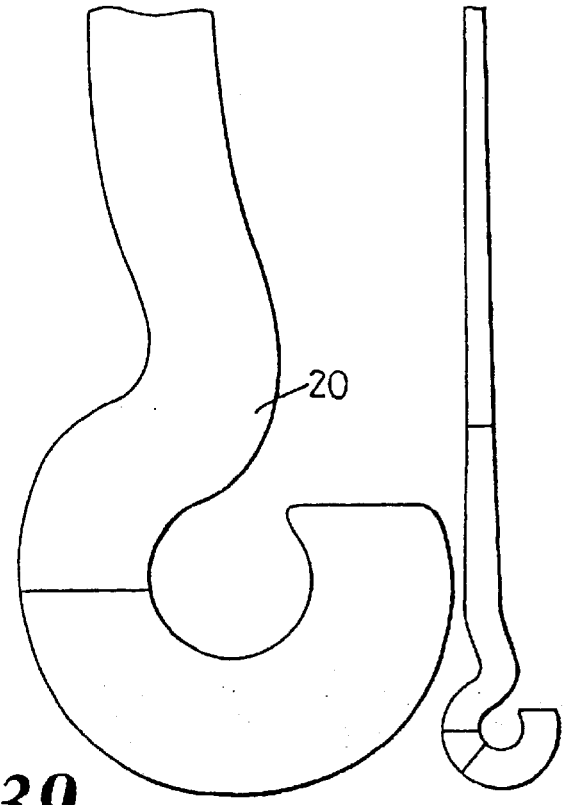
Figure 40:
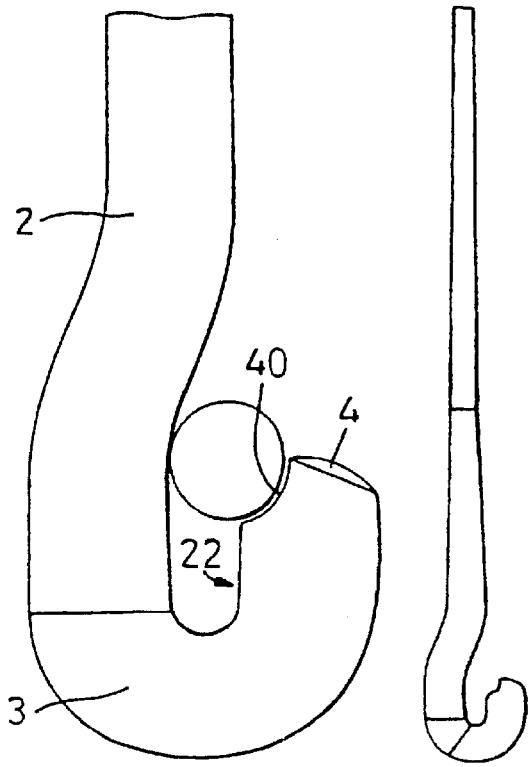

In FIG. 35, the shaft 1 has a forward curve 19 before the rearward curve 17, thus providing a knee 22 FIG. 36 illustrates an arrangement where the heel and toe have been truncated as indicated at 21. FIG. 37 shows an arrangement with a rearward curve 17 and a forward curve 18 and a modified form of distended gape. The shaft is also offset as shown. FIG. 38 shows an arrangement where the free end of the head for toe) is closely spaced from the opposite inner face of the shaft. FIG. 39 shows a further embodiment of hockey stick with a pronounced "knee" 20. FIGS. 40(*a*) and (*b*) show an arrangement in which the head is cut away at 40, adjacent the toe.

The illustrated embodiments possess one or more of the following advantageous features.

Ball Catching

The ball may be covered with part of the inner edge of the face whilst the stick is held face down, potentially allowing the ball to be moved whilst under control, changing its direction freely and safely through changes in the tilt of the shaft without losing the ball through either "squeezing out" or "riding over". The ball may also be dragged, giving power to a pass on the ground that has marked accuracy, as commonly used in putting out penalty corners. The catching action also has marked benefits in the stopping element of penalty corners and further can be effectively used to collect and prise the ball away from opponents in tackles.

Circulation

The head of the stick may be rotated around the ball whilst in continual contact with the ground, without disturbing the ball or changing the spatial location of the handle in the action. This ability consequently provides a greatly improved dribbling action.

Enlarged Playing Area

This achieves an increase in the area through which a ball will not pass, providing obvious advantages in collecting balls that are travelling above the surface or are bouncing. It improves one touch shooting in the circle and aids the attributes of flicking the ball and throwing aerials. Such an enlarged playing area is highly advantageous for the goal keeper who often has to contend with balls in the air and for whom small errors in judgement can be devastating.

Improved Balance of Playing Surfaces

This gives excellent control on both open and reverse sides designed for maximum value when the handle of the stick is held at between 35° and 55° to the ground. Combined with a comfortable weight distribution that brings to close proximity the three axes of rotation. In preferred embodiments of this invention, all three axes fall within 1.5 cm (as opposed to 4.5 cm in prior art sticks), with the axis of balance and axis of handle being practically identical. This makes the rotational handling superb, giving a "natural" feel to the stick in the hands.

Improved Reverse Stick Playing Skills

The actions of receiving the ball on the reverse, hitting and passing the ball on the reverse, lifting the ball on the reverse, chipping the ball on the reverse, throwing aerial balls on the reverse, flicking from the reverse, stopping in a block fashion on the reverse side or as a dead stop during penalty corners, are greatly facilitated.

APPENDIX

Abbreviations Used in This Specification $\alpha$=Gape playing angle (angle of inclination of the handle with the ground when the ball is held in a catching arrangement): see FIG. 6

$\alpha_{(min)}$=minimum playing angle that will present the centre of the gape circle at a height R above the ground; refer FIG. 24

B=height relative to ball at which the base of the gape is presented to the back of the ball; see FIG. 16

Cf=Forward displacement of toe relative to inner edge of shaft; see FIG. 5

Cor=Circumference of rotation; see FIG. 5

Cr=Rearward displacement of head relative to outer edge of shaft; see FIG. 4

D=Distance from base of stick to base of ball when held in a catching arrangement, see FIG. 17

Dor=Diameter of rotation; see FIG. 22

E=toe extension; see FIG. 23

F=facial width; see FIG. 5

$F_{(max)}$=maximum width of face=5 cm $F_{(min)}$=minimum width of face that will allow ball to be comfortably played, taken to be R+0.5 cm G=Gape, see FIGS. 3, 8

$G_{(max)}$=maximum gape, at any given playing angle, that will provide sufficient face at the base of the stick to consistently play the ball; refer FIG. 24

$G_{(min)}$=minimum gape, at any given playing angle, that will provide a cradling or encompassment effect; refer FIG. 24

GfH=the distance up the face of the stick to the most laterally displaced part of the inner edge resulting from a forward curve; see FIG. 5

H=Height of gape; see FIGS. 3, 8

L=perpendicular distance from lace of stick to centre of ball when the ball is held in a catching arrangement; see FIG. 16

PSo=Open stick playing surface; refer FIG. 6

PSr=Reverse stick playing surface; refer FIG. 6

PSTE=playing surface toe extension; see FIG. 6

PSTE(s)=shaft sided estimation of PSTE based on the playing surface ending on the outer edge; refer FIG. 6

PSTE(t)=Toe sided estimation of the PSTE based on the playing surface ending on the edge of the Toe; refer FIG. 6

R=radius of hockey ball, typically 3.5 cm

RCPo=Rotational contact point (open stick) see FIG. 23

RCPr=Rotational contact Point (reverse stick); see FIG. 23

T=height of Toe: see FIG. 3

$T_{(med)}$=toe length required to reach the median line of the ball; see FIG. 17

$T_{(min)}$=minimum height of toe at any given arrangement of width and playing angle, that will provide a sufficient face at the reverse end of the circulation to play the ball; refer FIG. 24

V=vertical height of top of toe when stick is inclined at α°; see FIG. 16

W=Width of head; see FIG. 3

Formulae Employed in Analysis of Preferred Embodiments, by Reference to Relevant Figures

FIG. 4

$$W=F+Cr+CF+\text{Space} \therefore \text{Space}=W-F-Cr-Cf$$

If "Space" is greater than 2R, the ball will pass beneath the shaft in a block reverse stick tackle.

Hence for effective block reverse tackles 2R>W−F−Cr−Cf. Where CfH−T>2R the above formula will not hold true and in circumstances such as this and those circumstances where no forward curving element exists or the forward curve occurs a distance less than 2R vertically above the toe, the following inequality applies 2R>W−F−Cr.

FIG. 6

Theoretical Formulae

For positive circulation:PSTE>R (i.e. sufficient extension of the toe past the rotational contact point should be provided to play the centre of the ball at R+0.5 cms above the ground when the stick is inclined at the encompassment playing angle of α)

$$\text{Reverse Stick Playing Surface (PSr)}\approx\text{PSTE(t)}+\text{PSHE}$$

$$\text{Open Stick Playing Surface (PSo)}\sim\text{PSTE(s)}+\text{PSHE}$$

Geometric Formulae $$\text{Dor}=\text{Cor}/\pi;\ \text{Cor}\approx\pi W(180-2\alpha)/180;$$

$$\therefore \text{Dor}\approx W(180-2\alpha)/180$$

$$\text{PSTE}\approx((W/2F_{(min)})\sin\alpha+(T-W/2))/\cos\alpha$$

FIG. 16

Theoretical Formulae

H−G/2>$F_{(min)}$ (i.e. the facial width of the base of the stick should be no smaller than the radius of the ball plus an allowance for wear and error, to allow for hitting, pushing and stopping of the ball in open play)

$$T>H+G/4$$

(i.e. for Absolute encompassment a recumbent element should be provided in the toe to hold the ball firmly)

B~≦R ∴ (H−G/2)sin α~≦R (i.e to overcome Squeezing-out the base of the gape should be applied at the half height line of the ball or below)

Geometric Formulae $$H\sin\alpha-L\cos\alpha=R$$

$$\alpha=\sin^{-1}(R/(H^2+L^2)^{0.5})+\tan^{-1}(L/H)$$

$$\theta=\sin^{-1}(G/(2R))$$

$$L=R\cos\theta$$

$$B=(H-G/2)\sin\alpha$$

FIG. 17

Theoretical Formulae

For complete encompassment:

H+G/2>$T_{(med)}$ (i.e. top of Gape passes median line of ball)

Therefore:

$$H+G/2>L\tan\alpha+H$$

$$G>2L\tan\alpha$$

Geometric Formulae $$\alpha=\sin^{-1}(R(H^2+L^2)^{0.5})+\tan^{-1}(L/H);$$

$$\theta=\sin^{-1}(G/(2R));$$

$$L=R\cos\theta$$

$$T_{(mid)}=L\tan\alpha+H$$

FIG. 22

Theoretical Formulae

For positive circulation:

a. The whole semi-circle of rotation must lie outside the bounds of the ball.

b. The diameter of the semicircle of rotation (Dor) must be greater than the diameter of the ball (2R). Dor>2R c. The extent of the toe at 4 cm height off the ground when inclined at the playing angle (α) on the reverse stick (PSTE) must be greater than the radius of the ball (R). PSTE>R e. The Circumference of Rotation (Cor) is the distance around the outside edge of the head between RCPo and RCPr Geometric Formulae $$Dor=Cor/\pi$$

$$Cor\cong\pi W(180-2\alpha)/180$$

$$\therefore Dor\cong W(180-2\alpha)/180$$

FIG. 23

Theoretical Formulae

In all experimental cases 'PSTE(t)' has proved the more accurate approximation of PSTE. Where 'PSTE' is defined as equal to 'R'(3.5 cm) the minimum toe height '$T_{(min)}$' for circulation can be determined for the complete range of playing angles.

The Circumference of Rotation (Cor) is the distance around the outer edge of the head from RCPo to RCPr; for a generally circular head this distance approximates to $\pi W(180-2\alpha)/180$ Geometric Formulae $$\alpha=\sin^{1}(R/H^{2}+L^{2})^{0.5})+\tan^{-1}(L/H)$$

$$\theta=\sin^{-1}(G/(2R))$$

$$L=R\cos\theta$$

$$T=E+W/2$$

$$PSHE\cong(4W-F(_{(min)})^{2})^{0.5}$$

PSTE≅the lesser of:

$$PSTE(t)\cong((W/2-F(_{(min)})\sin\alpha+(T-W/2))/\cos\alpha, \text{ or}$$

$$PSTE(s)\cong(F_{(min)}+((W/2-F_{(min)})(1-\cos\alpha)))/\sin\alpha$$

$$Cor\cong\pi W(180-2\alpha)/180$$

FIG. 24

$\alpha_{(min)}$ is defined by $\alpha_{(min)}=\sin^{-1}(R/H_{(max)})$ where $H_{(max)}=T_{(max)}+G_{(max)}/2$ $G_{(min)}$ is defined by the intersection of $H=T_{(max)}$ and $$H\sin\alpha-L\cos\alpha=R$$

$G_{(max)}$ is defined by the intersection of $H-G/2=R$ and $$H\sin\alpha-L\cos\alpha=R$$

$T_{(min)}$ is defined by $PSTE(t)=R$ $$\therefore R\cong((W/2-(R+0.5))\sin\alpha+(T_{(min)}-W/2))/\cos\alpha$$

What is claimed is:

1. A hockey stick comprising an elongate handle merging at a lower end with a shaft which merges at a lower end with a head which terminates with a toe, wherein the head has a curvature of at least 140°, and a maximum gape, between limbs of the head and the shaft, which is at least 3 cm, but less than the diameter of a standard hockey ball, with the gape being unobstructed wherein said maximum gape is defined as the diameter of the largest notional circle that fits between an inner edge of the head adjacent the shaft, and an end of the head adjacent the toe, making contact with the inner edge of the head, but not the toe.

2. A hockey stick as claimed in claim 1, wherein the maximum gape is at least 3.5 cm.

3. A hockey stick as claimed in claim 2, wherein the maximum gape is approximately 5.5 cm.

4. A hockey stick as claimed in claim 1, having a said gape circle with a gape (G) and a gape height (H) in accordance with the following relationship:

$$G>7.7-2H/5,$$

wherein the gape height (H) is the vertical distance from the ground to the centre of said notional gape circle when the stick is held with the handle vertical and the head of the stick in contact with the ground.

5. A hockey stick as claimed in claim 1, having a said gape circle with a gape (G) and a gape height (H) in accordance with the following relationship:

$$G>7.65-4H/11,$$

wherein the gape height (H) is the vertical distance from the ground to the centre of said notional gape circle when the stick is held with the handle vertical and the head of the stick in contact with the ground.

6. A hockey stick as claimed in claim 1, having a said gape circle with a gape (G) and a gape height (H) in accordance with the following relationship:

$$G>10.3-4H/5,$$

wherein the gape height (H) is the vertical distance from the ground to the centre of said notional gape circle when the stick is held with the handle vertical and the head of the stick in contact with the ground.

7. A hockey stick as claimed in claim 1, having a said gape circle with a gape (G) and a gape height (H) in accordance with the following relationship:

$$G>5H/6-1.25$$

wherein the gape height (H) is the vertical distance from the ground to the centre of said notional gape circle when the stick is held with the handle vertical and the head of the stick in contact with the ground.

8. A hockey stick as claimed claim 1, wherein a toe height (T) is greater than 8 cm.

9. A hockey stick as claimed in claim 1, wherein the overall width of the head (W) is greater than 12.5 cm.

10. A hockey stick as claimed in claim 1, wherein the stick incorporates a rearward curve in the region of the stick adjacent the merger of the shaft and the head.

11. A hockey stick as claimed in claim 1, wherein the stick incorporates a forward curve in the region of the stick adjacent the merger of the shaft and head.

* * * * *

UNITED STATES PATENT AND TRADEMARK OFFICE

CERTIFICATE OF CORRECTION

PATENT NO. : 6,547,683 B1 
DATED : April 15, 2003
INVENTOR(S) : Ian Robert Malcom Howgate It is certified that error appears in the above-identified patent and that said Letters Patent is hereby corrected as shown below:

Drawings,
Figures 20, 25, 27 and 28, replace the word "Tuti" found at the reference lead line "1" with the word -- Tufi --.
Figures 20 and 27, replace the word "I plum" found at the reference lead line "i" with the word -- upturn --.

Signed and Sealed this

Thirtieth Day of March, 2004

JON W. DUDAS
*Acting Director of the United States Patent and Trademark Office*